US008136786B2

(12) United States Patent
Kepes et al.

(10) Patent No.: US 8,136,786 B2
(45) Date of Patent: Mar. 20, 2012

(54) FOLDING WIRE EASEL

(76) Inventors: George Kepes, Studio City, CA (US); Jianping Fang, Lakewood, CA (US)

( * ) Notice: Subject to any disclaimer, the term of this patent is extended or adjusted under 35 U.S.C. 154(b) by 169 days.

(21) Appl. No.: 12/569,879

(22) Filed: Sep. 29, 2009

(65) Prior Publication Data

US 2011/0073741 A1 Mar. 31, 2011

(51) Int. Cl.
*A47B 41/06* (2006.01)
*A47B 97/04* (2006.01)

(52) U.S. Cl. ..... 248/465.1; 248/166; 248/175; 248/435; 248/440; 248/460; 248/465

(58) Field of Classification Search ..... 248/166, 248/434, 435, 168, 440, 175, 170, 171, 465.1, 248/465

See application file for complete search history.

(56) References Cited

U.S. PATENT DOCUMENTS

| | | | | |
|---|---|---|---|---|
| 2,289,729 | A * | 7/1942 | Robinson et al. | 248/27.8 |
| 3,148,850 | A * | 9/1964 | Johnson | 248/27.8 |
| 7,918,073 | B2 * | 4/2011 | Weder | 53/473 |
| 7,958,702 | B2 * | 6/2011 | Weder | 53/473 |

* cited by examiner

*Primary Examiner* — Amy J Sterling
(74) *Attorney, Agent, or Firm* — Morgan, Lewis & Bockius LLP; Brett Lovejoy

(57) ABSTRACT

A collapsible easel with three legs is provided. First ends of the three legs are attached at an apex. The legs are moveable with respect to one another about the apex. The legs are moveable between collapsed and opened positions. The legs are disposed substantially adjacent one another in the collapsed position. The second ends of the legs are spaced a distance away from each other in the opened position. The legs form an upright pyramidal configuration when in the opened position. The easel is supported by a collapsible reinforcing member joining two of the legs. The reinforcing member has first and second arms joined by a pivoting mechanism. The easel is also reinforced by a collapsible bracing assembly comprising alpha, beta, and gamma support members attached to the set of three legs.

21 Claims, 24 Drawing Sheets

FOLDING WIRE EASEL

TECHNICAL FIELD

This invention relates to a novel collapsible easel, and is more particularly concerned with such a display holding device which is easily and rapidly set up and which may be selectively quickly collapsed and set up again without special tools or capabilities and which may be conveniently stored and transported in minimum space.

BACKGROUND ART

Easels have been used in industries such as, for example, art, photography, music, education, framing and the like to support and display designated items. These non-floral easels are expensive to fabricate and unsuitable for use as a floral easel.

In the floral industry, floral easels are usually constructed of wood or non-wood materials, such as, for example, steel wire. Thus, as used herein, easels that are constructed from non-wood materials are referred to as wire easels. Both wood and wire easels for use in industries such as the floral industry are usually cumbersome and difficult to ship, transport, and store in that they do not have the ability to readily fold into a position that is compact and easily manageable.

Typically, for example, at least two legs of known easels for use in industries, such as the floral industry, are in an open, fixed (erected) position making it impossible to fold the easel into a compact bundle for transportation. Often, florists attach floral arrangements to these wood or wire easels by affixing the floral arrangement to the two legs that are in the open, fixed (erect) position and transport the easels with only a third leg being collapsed. After a funeral visitation or service in the funeral home or chapel, the only collapsible leg of the easel is collapsed while the other legs remain in the open and erect position. The easel is then transported to the cemetery where the collapsible leg is again erected, usually with the legs pressed several inches into the soil for anchoring purposes. The display is used again during a grave side service or as a decoration at the grave site after the service. These easels are frequently transported to various ceremonies and discarded after the ceremony.

The transportability of conventional easels is therefore not maximized because of the bulky nature of such easels, and recyclability of conventional easels is inadequate due to their bulky nature. Further, shipping and/or freight costs currently reflect the cumbersome nature of shipping conventional easels. For example, depending on the freight zone, freight costs may range from 9 to 36 percent of the total manufacturing costs. This is because conventional easels, such as conventional collapsible wire easels for use in the floral industry, are produced in a factory and shipped to a designated location with two of the three legs fixed in the erected position with only one of the legs being collapsible. Shipping these types of easels is costly due to the large amount of space the easel requires because of its inability to fully collapse into a bundle. An easel for use in the floral industry, for example, that is fully or partially collapsible would dramatically decrease shipping costs. As an example, a fully or partially collapsible wire easel may reduce freight costs by up to 75% when compared to the freight costs of known wire easels.

Warehousing space must also be maximized to accommodate storage of such easels. For example, when arriving at a distributorship or flower shop, conventional easels require the manufacturer, distributor or florist to provide an excessive and unnecessary amount of storage space for the easel which is attributed to the inability of the easel to fully collapse. Also, the reuse of conventional collapsible easels by florists is poor or even non-existent due to the extreme difficulty of packing and transporting the easels.

Conventional wood easels are typically bulkier than wire easels and require more space even when the conventional wood easel is in a partially collapsed or fully collapsed position. Furthermore, wood is a scarce natural resource and alternative materials are more readily available for the construction of easels. Moreover, conventional wire easels are subject to warping upon continued use, especially when storing. These easels must be stored in a careful manner, avoiding exposure to certain conditions and must be disposed in a flat plane because of a tendency to conform to a non-linear plane. Conventional wood easels also suffer drawbacks because they are subject to insect infestation which requires irradiation when importing (or otherwise be subject to recall), and subject to splintering making the conventional wood easels difficult to transport in commerce as well as difficult to use and re-use. The wood of conventional wood floral easels must also be treated to provide the desired surface conditions (e.g., for sanding or painting) making the material prohibitively expensive when compared to other non-wood materials from which the easel could be constructed. Conventional wood easels also require assembly as well as articulation among the legs.

U.S. Pat. No. 7,426,813 is directed to a wire frame collapsible easel suitable for use in the floral industry. However, the easels disclosed in U.S. Pat. No. 7,426,813 have the drawback that the supporting bracing assemblies, which brace the legs of the easel when the easel is in the open position, are not fixedly mounted to the legs of the easel. Thus, the easels disclosed in U.S. Pat. No. 7,426,813 lack the desirable stability and durability. Moreover, the manner in which the legs of the easels disclosed in U.S. Pat. No. 7,426,813 are joined together at their apex requires the use of a retaining member 180, typically a hook, to force the legs of the easel to stay together when in the collapsed position. This retaining member causes the wire easel to warp over time and limits the usable lifetime of easel.

It is to this end that there is a need in the industry for improved fully or partially erectable or collapsible wire easels that overcome the disadvantages and defects of known easels and that is compact, easily transportable, less expensive to ship and store, and is fully reuseable.

SUMMARY

The present disclosure addresses the above-described need in the art. A collapsible easel is provided. The collapsible easel has a set of three legs. Each of the three legs has a first end and a second end. The first end of each of the three legs is attached with one another at an apex. The three legs are moveable with respect to one another about this apex such that the three legs are moveable between a collapsed position and an opened position and all points between the collapsed position and an opened position.

Each of the three legs are disposed substantially adjacent one another in the collapsed position. The second end of each of the three legs is spaced a distance away from each other in the opened position. The three legs form an upright pyramidal configuration when the three legs are in the opened position with the second end of each of the three legs engaging a substrate.

In addition to the three legs, the collapsible is supported by a reinforcing member and a bracing assembly.

The reinforcing member comprises a first reinforcing arm, a second reinforcing arm and a pivoting mechanism that joins the first reinforcing arm and the second reinforcing arm. The first reinforcing arm is fixedly attached to a first attachment point of a first leg in the set of three legs. The first reinforcing arm is configured to pivot about this first attachment point of the first leg. The second reinforcing arm is fixedly attached to a first attachment point of a second leg in the set of three legs. The second reinforcing arm is configured to pivot about the first attachment point of the second leg. The reinforcing member is pivotable, about the pivoting mechanism, between a first reinforcing member position and a second reinforcing member position.

The bracing assembly comprises (i) an alpha support member, (ii) a beta support member, and (iii) a gamma support member.

The alpha support member comprises (a) a first alpha arm, (b) a second alpha arm, and (c) an interlocking mechanism that joins the first alpha arm and the second alpha arm. The first alpha arm is fixedly attached to a second attachment point of the first leg. The first alpha arm is configured to pivot about the second attachment point of the first leg. The second alpha arm is fixedly attached to a second attachment point of the second leg. The second alpha arm is configured to pivot about the second attachment point of the second leg. The alpha support member is pivotable about the interlocking mechanism between a first alpha support member position and a second alpha support member position.

The beta support member comprises a first end and a second end. The first end of the beta support member is fixedly attached to the second attachment point of the first leg. The first end of the beta support member is configured to pivot about the second attachment point of the first leg. The second end of the beta support member is slidably attached to a third leg in the set of three legs. The beta support member is pivotable about the first end of the beta support member between a first beta support member position and a second beta support member position.

The gamma support member comprises a first end and a second end. The first end of the gamma support member is slidably attached to the third leg. The second end of the gamma support member is fixedly attached to the second attachment point of the second leg. The second end of the gamma support member is configured to pivot about the second attachment point of the second leg. The third gamma member is pivotable about the second end of the gamma support member between a first gamma support member position and a second gamma support member position.

The second end of the beta support member and the first end of the gamma support member are attached to each other.

The set of three legs, the reinforcing member, and the bracing assembly are configured so that when the three legs are in the collapsed position, the reinforcing member is in the first reinforcing member position, the alpha support member is in the first alpha support member position, the beta support member is in the first beta support member position, and the gamma support member is in the first gamma support member position.

The set of three legs, the reinforcing member, and the bracing assembly are configured so that when the three legs are in the opened position, the reinforcing member is in the second reinforcing member position, the alpha support member is in the second alpha support member position, the beta support member is in the second beta support member position, and the third gamma member is in the second gamma support member position. In preferred embodiments, each of these elements moves in a cohesive, coordinated fashion between the opened position and the collapsed position.

The disclosed easels have the advantage of substantially reducing the size of cartons necessary to ship such easels.

BRIEF DESCRIPTION OF THE DRAWINGS

The features and advantages of the present invention will be better understood by reference to the following detailed description, which should be read in conjunction with the accompanying drawings.

Like reference numerals refer to corresponding parts throughout the several views of the drawings.

DETAILED DESCRIPTION OF THE INVENTION

Figure 1:
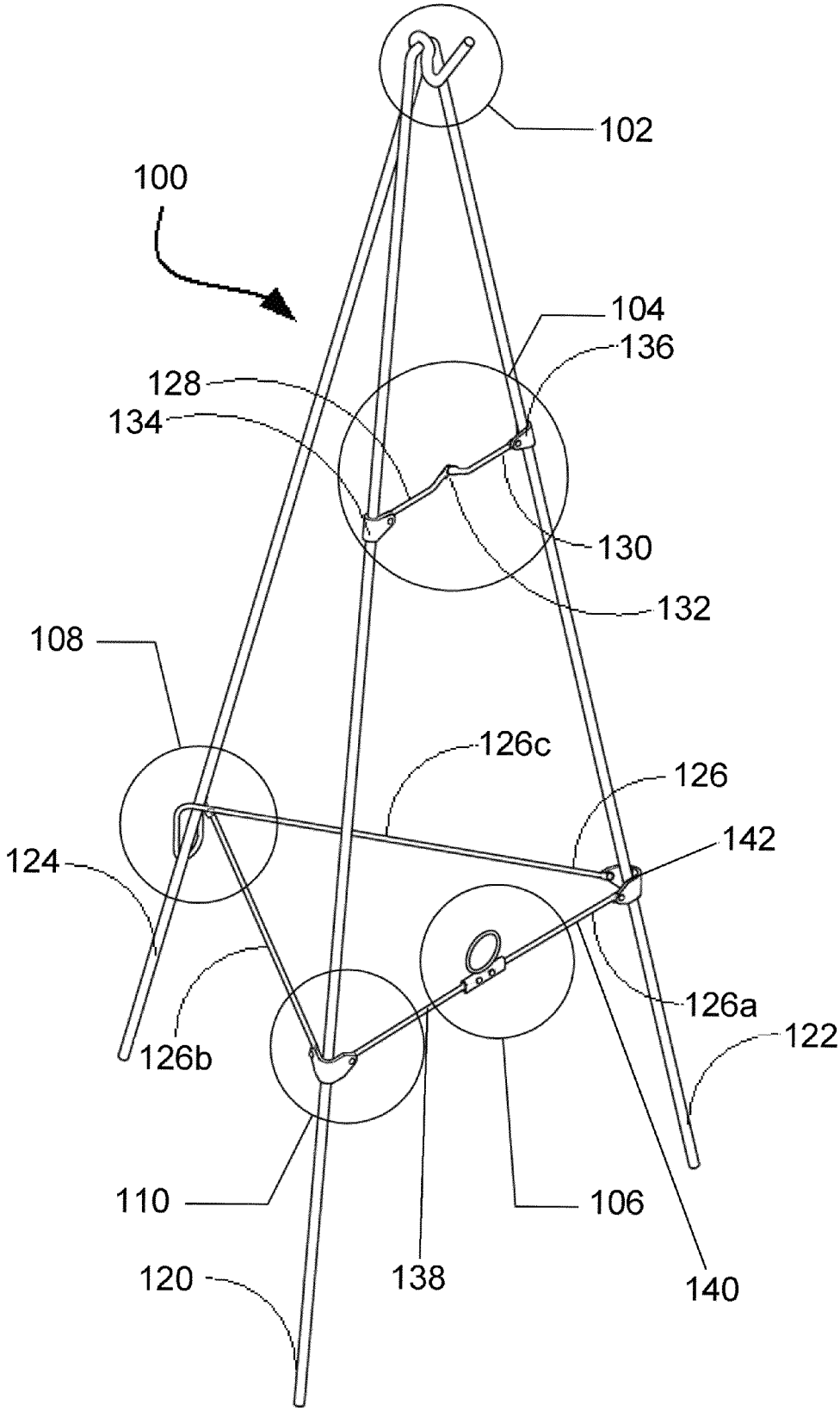
FIG. 1 is a perspective view of an erectable or collapsible easel, in accordance with the present disclosure, in an opened position.

Referring to FIG. 1, there is shown a perspective view of an erectable or collapsible easel 100, in accordance with the present disclosure, in an opened position. The collapsible easel has a set of three legs. A first leg 120, a second leg 122, and a third leg 124. Each of the three legs has a first end and a second end. The first end of each of the three legs is attached with one another at an apex 102. The three legs are moveable with respect to one another about this apex 102 such that the three legs are moveable between a collapsed position and an opened position and all points between the collapsed position and an opened position.

Each of the three legs are disposed substantially adjacent one another in the collapsed position. The second end of each of the three legs is spaced a distance away from each other in the opened position. The three legs form an upright pyramidal configuration when the three legs are in the opened position with the second end of each of the three legs engaging a substrate.

In addition to the three legs, the collapsible is supported by a reinforcing member 104 and a bracing assembly 126.

The reinforcing member 104 comprises a first reinforcing arm 128, a second reinforcing arm 130, and a pivoting mechanism 132 that joins the first reinforcing arm 128 and the second reinforcing arm 130. The first reinforcing arm 130 is fixedly attached to a first attachment point 134 of the first leg 120. The first reinforcing arm 128 is configured to pivot about this first attachment point 134 of the first leg 120. The second reinforcing arm 130 is fixedly attached to a first attachment point 136 of the second leg 122. The second reinforcing arm 130 is configured to pivot about the first attachment point 136 of the second leg 122. The reinforcing member 104 is pivotable, about the pivoting mechanism 132, between a first reinforcing member position and a second reinforcing member position.

The bracing assembly 126 comprises (i) an alpha support member 126*a*, (ii) a beta support member 126*b*, and (iii) a gamma support member 126*c*.

The alpha support member 126*a* comprises (a) a first alpha arm 138, (b) a second alpha arm 140, and (c) an interlocking mechanism 106 that joins the first alpha arm 138 and the second alpha arm 140. The first alpha arm 138 is fixedly attached to a second attachment point 110 of the first leg 120. The first alpha arm 138 is configured to pivot about the second attachment point 110 of the first leg 120. The second alpha arm 140 is fixedly attached to a second attachment point 142 of the second leg 122. The second alpha arm 140 is configured to pivot about the second attachment point 142 of the second leg 122. The alpha support member 126*a* is pivotable about the interlocking mechanism 106 between a first alpha support member position and a second alpha support member position.

The beta support member 126*b* comprises a first end and a second end. The first end of the beta support member 126*b* is fixedly attached to the second attachment point 110 of the first leg 120. The first end of the beta support member 126*b* is configured to pivot about the second attachment point 110 of the first leg 120. The second end of the beta support member is slidably attached to the third leg 126*b* at position 108. The beta support member 126*b* is pivotable about the first end of the beta support member 126*b* between a first beta support member position and a second beta support member position.

The gamma support member 126*c* comprises a first end and a second end. The first end of the gamma support member is slidably attached to the third leg 124 at position 108. The second end of the gamma support member 126*c* is fixedly attached to the second attachment point 142 of the second leg 122. The second end of the gamma support member 126*c* is configured to pivot about the second attachment point 142 of the second leg 122. The third gamma member 126*c* is pivotable about the second end of the gamma support member 126*c* between a first gamma support member position and a second gamma support member position.

The second end of the beta support member 126*b* and the first end of the gamma support member 126*c* are attached to each other.

The set of three legs (120, 122, and 124), the reinforcing member 104, and the bracing assembly 126 are configured so that when the three legs are in the collapsed position, the reinforcing member 104 is in the first reinforcing member position, the alpha support member 126*a* is in the first alpha support member position, the beta support member 126*b* is in the first beta support member position, and the gamma support member 126*c* is in the first gamma support member position.

The set of three legs, the reinforcing member, and the bracing assembly are configured so that when the three legs are in the opened position, the reinforcing member is in the second reinforcing member position, the alpha support member is in the second alpha support member position, the beta support member is in the second beta support member position, and the third gamma member is in the second gamma support member position.

Figure 2:
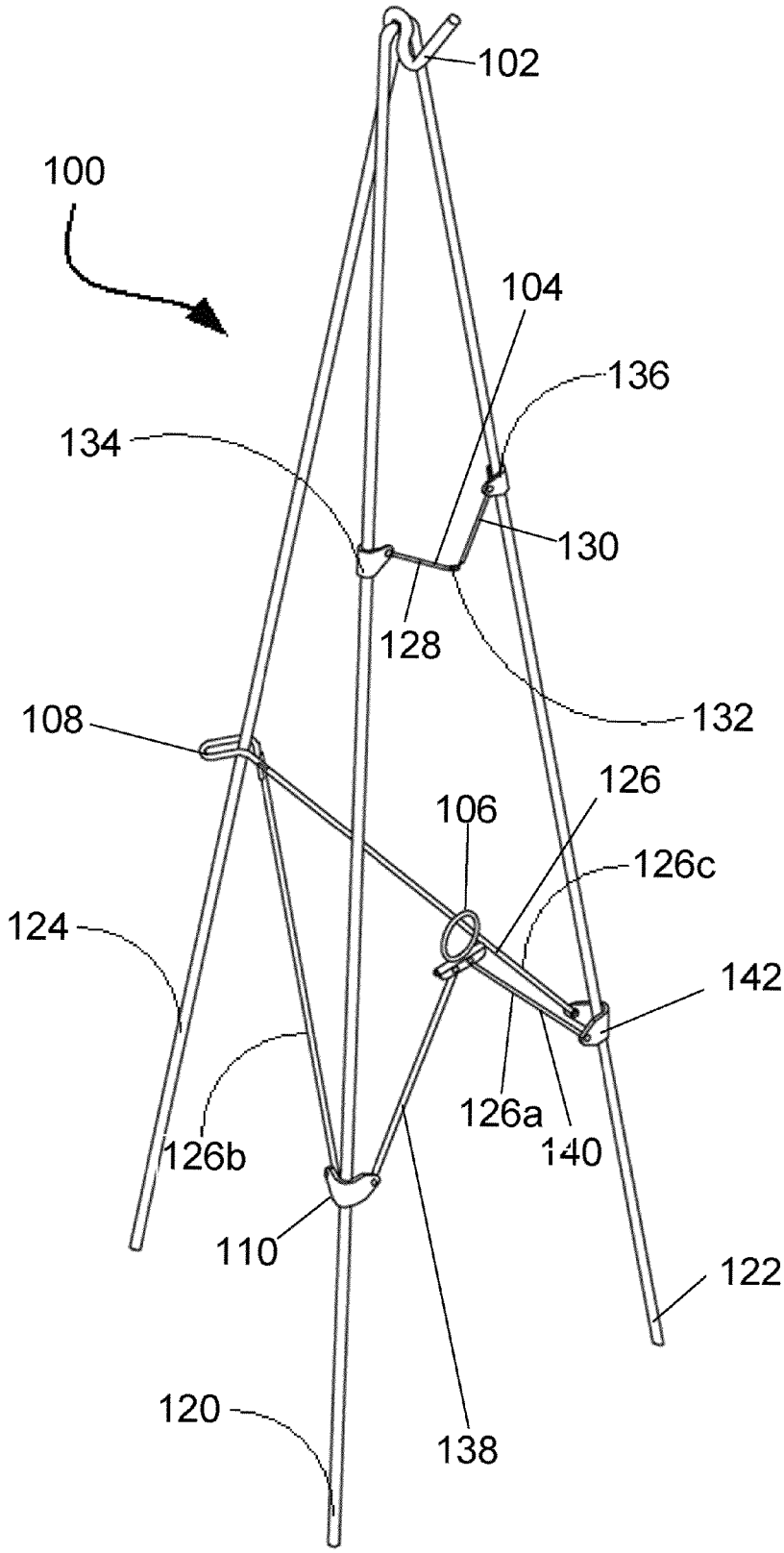
FIG. 2 is a perspective view of an erectable or collapsible easel, in accordance with the present disclosure, in a half-opened position.
Figure 3:
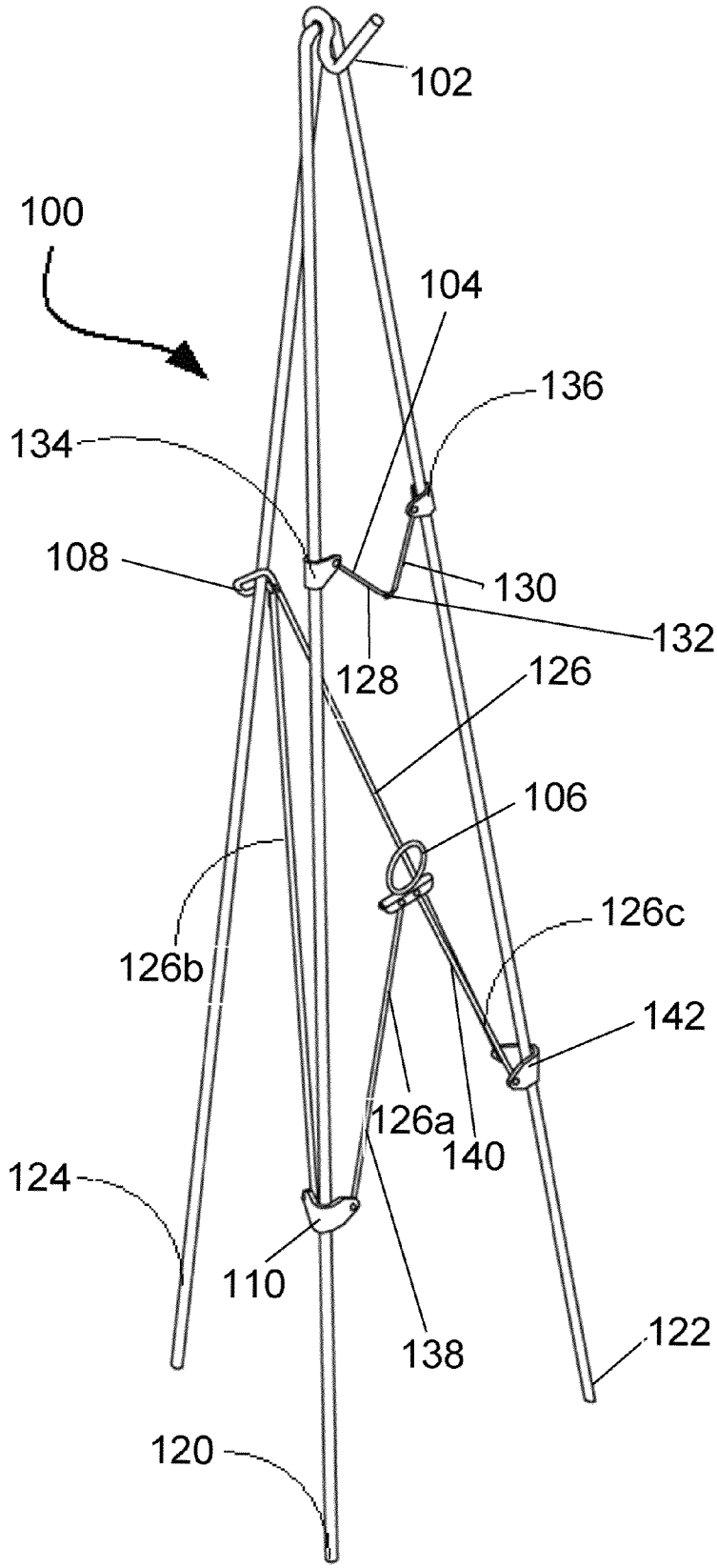
FIG. 3 is a perspective view of an erectable or collapsible easel, in accordance with the present disclosure, in a quarter-opened position.

FIG. 2 is a perspective view of the erectable or collapsible easel 100, in accordance with the present disclosure, in a half-opened position. FIG. 3 is a perspective view of an erectable or collapsible easel 100, in accordance with the present disclosure, in a quarter-opened position.

The term "erectable", "erect", "open", or "opened", are used interchangeably herein and mean that the easel 100 is deployed fully for use as intended, e.g., the display of a floral object.

The term "collapsible", "collapsed", or "closed" are used interchangeably herein and mean that the easel 100 is positioned such that the legs 120, 122, 124 are capable of being in or are in a fully or partially collapsed position.

The term "fully erectable" as used herein means that the legs 120, 122, 124 are capable of being in or are positioned in the open position.

The term "partially erectable" or "semi-erectable" as used herein means that the legs 120, 122, 124 are in a partially erected position.

The easel 100 may be fully or partially collapsible.

The term "fully collapsible" as used herein means that the legs 120, 122, 124 are capable of being positioned in the fully collapsed position.

The term "partially collapsible" and "semi-collapsible" are used interchangeably herein and mean that the legs 120, 122, 124 are in a fully collapsed position or partially collapsed position.

In some embodiments, the easel 100 is reversibly erectable. In some embodiments the easel 100 is irreversibly erectable. In some embodiments the easel 100 may only be capable of erecting yet not collapsing. In some embodiments the easel 100 may only be capable of collapsing yet not erecting. In some embodiments the easel 100 is capable of both erecting and collapsing.

All embodiments of the easel 100 described herein could be used with or without anchoring materials known in the art to prevent the easel 100 from moving or tipping. Examples of anchoring materials include, but are not limited to, adhesive, cohesive, spikes (metal or plastic), rubber feet or pads, combinations thereof, or any other materials capable of anchoring the easel 100 to a substrate (e.g., the floor or ground, not shown). The anchoring material may be formed integrally or non-integrally with the easel 100 and may be constructed of the same or different material as the floral easel 100.

In all of the embodiments of the easel 100 described herein, the legs 120, 122, and 124, first reinforcing arm 128, second reinforcing arm 130, first alpha arm 138 second alpha arm 140, beta support member 126*b*, and gamma support member 126*c* may be constructed from the same or different materials such as, for example, steel rod (tubular, flat, or profile shaped) and/or wire (coated or uncoated), aluminum rod (tubular, flat, or profile shaped) and/or wire (coated, anodized or uncoated), stainless steel rod (flat or profile shaped) and/or wire (coated or uncoated), plastic pieces of material having cylindrical, tubular, triangular, square, rectangular, polygonal, or other profile shapes or cross-sections of profile shapes, hollow, tubular or profile shaped materials made of metals or polymers, solid or hollow wood, synthetic or man-made materials, natural materials, or any other suitable material.

In typical embodiments, the legs 120, 122, and 124, first reinforcing arm 128, second reinforcing arm 130, first alpha arm 138 second alpha arm 140, beta support member 126*b*, and gamma support member 126*c* are constructed of substantially rigid materials.

The legs 120, 122, and 124, first reinforcing arm 128, second reinforcing arm 130, first alpha arm 138 second alpha arm 140, beta support member 126*b*, and gamma support member 126*c* leg members may have any size diameter, width, or profile dimensions and/or any length that is desired and useful for the particular use the easel 100 is put. In some embodiments, the easel 100 will have a height of from about ½" to 300", more preferably a height from about 10" to about 60", and most preferably a height from about 18" to about 36".

Figure 4A:
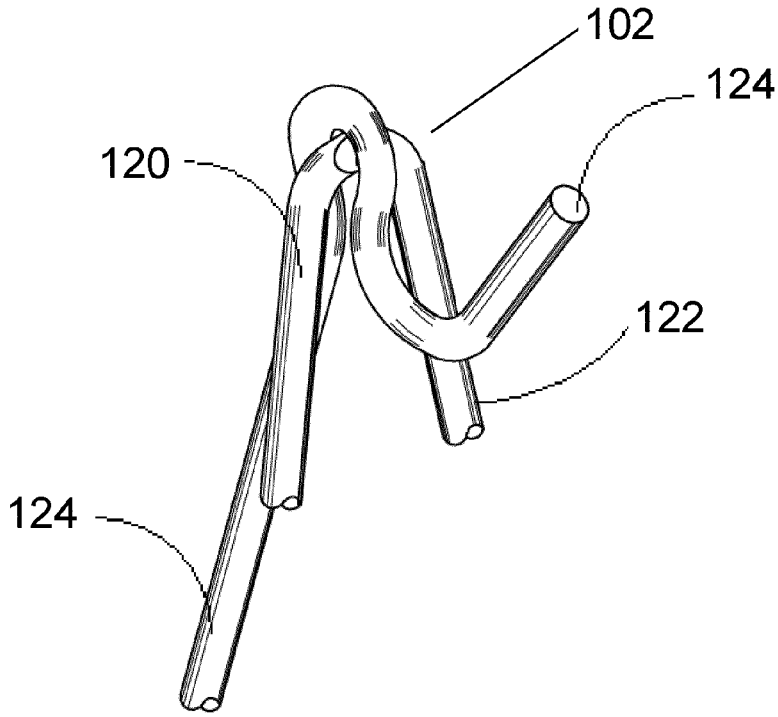
FIG. 4A is a perspective view of a first embodiment of the apex of an erectable or collapsible easel, in an assembled state, in accordance with the present disclosure.
Figure 4B:
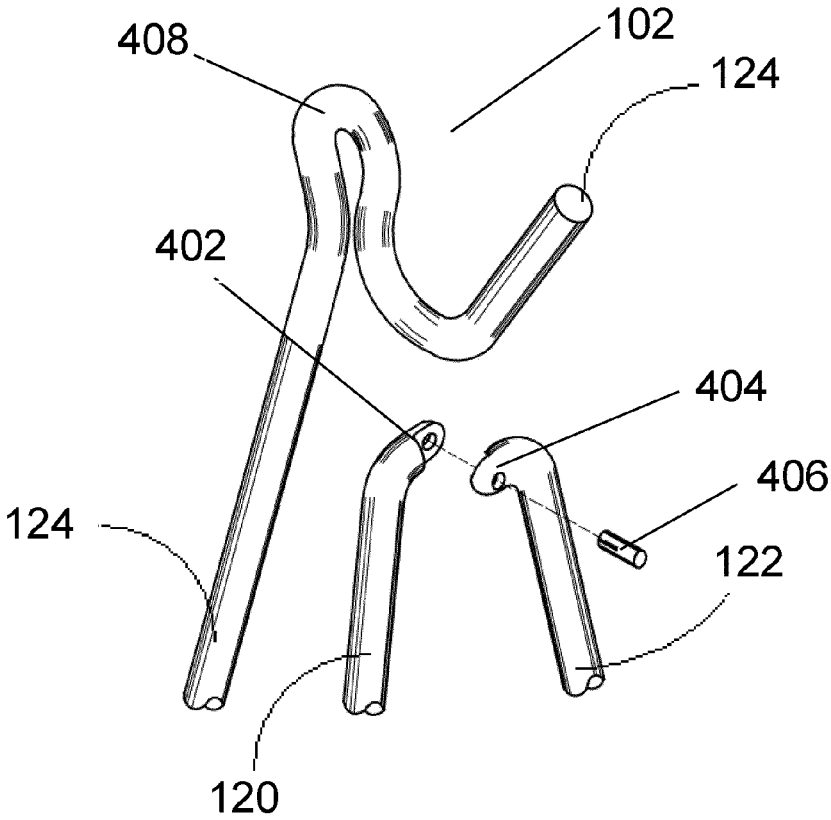
FIG. 4B is a perspective view of the first embodiment of the apex of an erectable or collapsible easel, in an unassembled state, in accordance with the present disclosure.

FIG. 4A is a perspective view of a first embodiment of apex 102 of an erectable or collapsible easel 100, in an assembled state, in accordance with the present disclosure. FIG. 4B is a perspective view of same first embodiment of the apex 102, in an unassembled state, in accordance with the present disclosure. In this first embodiment, the first end of the first leg 120 comprises a first bore hole 402 and the first end of the second leg 122 comprises a second bore hole 404. The apex comprises a pivot pin 406 that engages first end of the first leg 120 through the first bore hole 402 and engages the first end of the second leg 122 through the second bore hole 404 thereby pivotably joining the first end of the first leg to the first end of the second leg. The first end of the third leg comprises a bend 408 that engages the first leg 120 and the second leg 122 at the apex 102 thereby pivotably attaching the third leg 124 to the first leg 120 and the second leg 122.

Figure 5A:
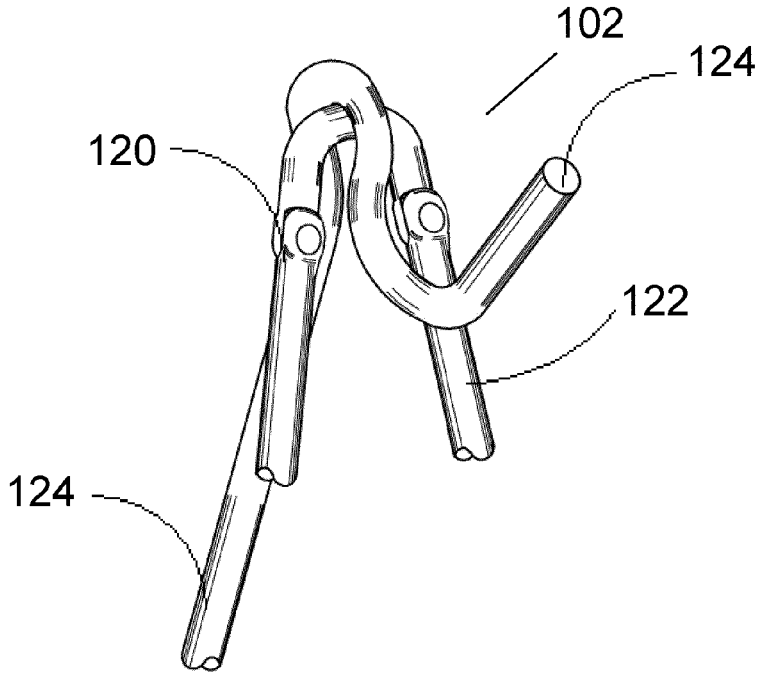
FIG. 5A is a perspective view of a second embodiment of the apex of an erectable or collapsible easel, in an assembled state, in accordance with the present disclosure.
Figure 5B:
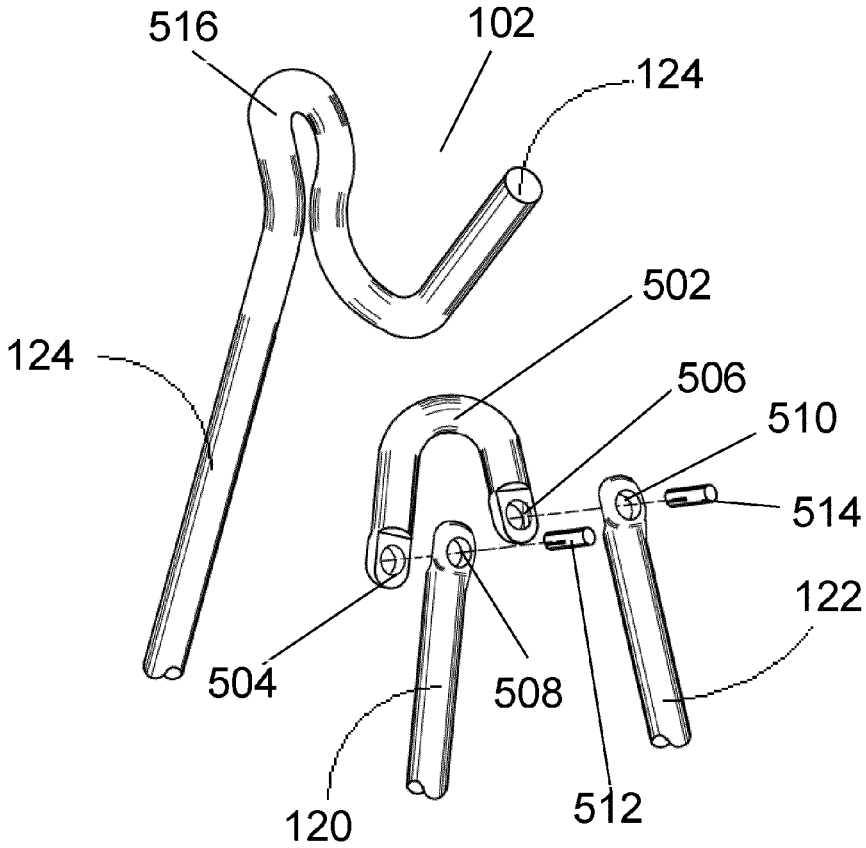
FIG. 5B is a perspective view of the second embodiment of the apex of an erectable or collapsible easel, in an unassembled state, in accordance with the present disclosure.

FIG. 5A is a perspective view of a second embodiment of the apex 102 of an erectable or collapsible easel 100, in an assembled state, in accordance with the present disclosure. FIG. 5B is a perspective view of the second embodiment of the apex 102 in an unassembled state, in accordance with the present disclosure. In this second embodiment, the apex 100 comprises a u-shaped member 502 comprising a first end and a second end. The first end of the u-shaped member 502 comprises a first bore hole 504. The second end of the u-shaped member 502 comprises a second bore hole 506. The first end of the first leg 120 comprises a third bore hole 508. The first end of the second leg 122 comprises a fourth bore hole 510. A first pivot pin 512 engages the first end of the u-shaped member 502 through the first bore hole 504 and engages the first end of the first leg 120 through the third bore hole 508 thereby pivotably joining the first end of the first leg to the first end of the u-shaped member. A second pivot pin 514 engages the second end of the u-shaped member 502 through the second bore hole 506 and engages the first end of the second leg 122 through the fourth bore hole 510 thereby pivotably joining the first end of the second leg to the second end of the u-shaped member. The first end of the third leg 124 comprises a bend 516 that engages the u-shaped member 502 thereby attaching the third leg 124 to the first leg 120 and the second leg 122.

Figure 6A:
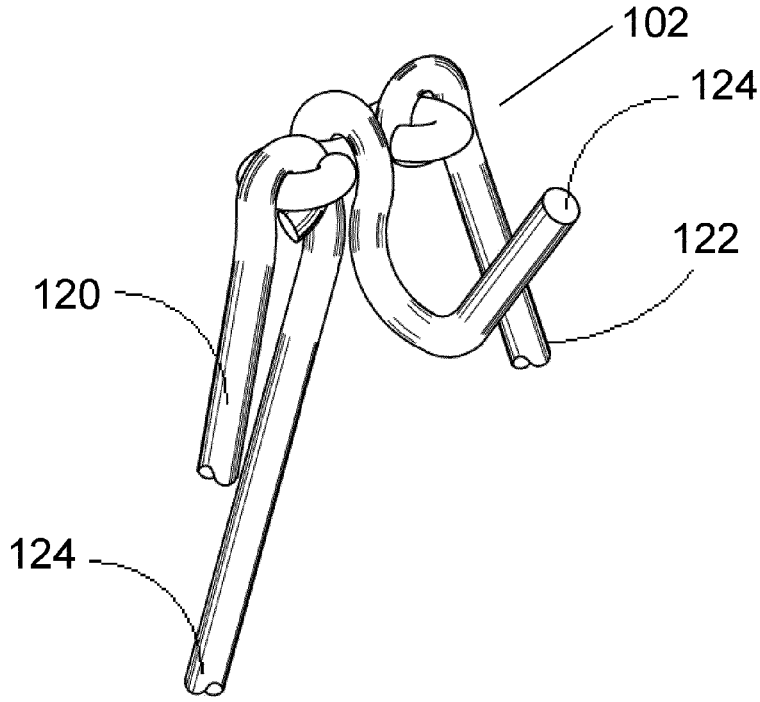
FIG. 6A is a perspective view of a third embodiment of the apex of an erectable or collapsible easel, in an assembled state, in accordance with the present disclosure.
Figure 6B:
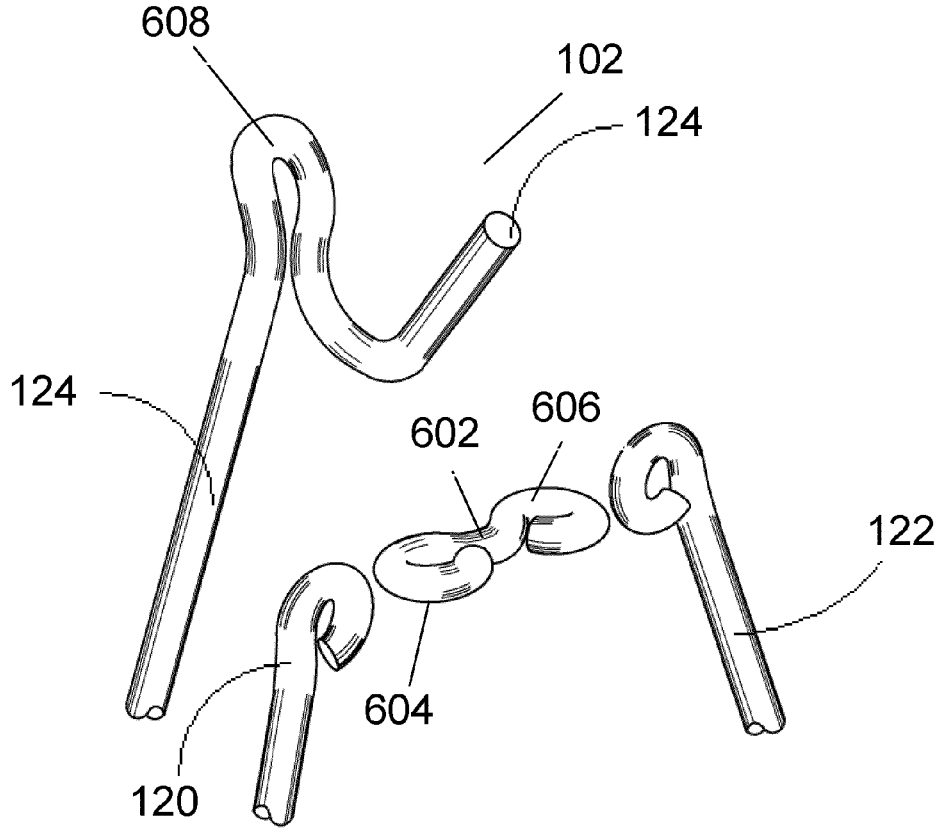
FIG. 6B is a perspective view of the third embodiment of the apex of an erectable or collapsible easel, in an unassembled state, in accordance with the present disclosure.

FIG. 6A is a perspective view of a third embodiment of the apex 102 of an erectable or collapsible easel 100, in an assembled state, in accordance with the present disclosure. FIG. 6B is a perspective view of the third embodiment of the apex 100 in an unassembled state, in accordance with the present disclosure. In the third embodiment, the apex 100 comprises a rigid interlinking member 602 having a first hook 604 and a second hook 606. The first end of the first leg 120 is pivotably joined to the first hook 604 of the rigid interlinking member 602. The first end of the second leg 122 is pivotably joined to the second hook 606 of the rigid interlinking member 602. The first end of the third leg 124 comprises a bend 608 that engages an intermediate portion of the rigid interlinking member 602 between the first hook 604 and the second hook 606 thereby attaching the third leg 124 to the first leg 120 and the second leg 122.

Figure 7A:
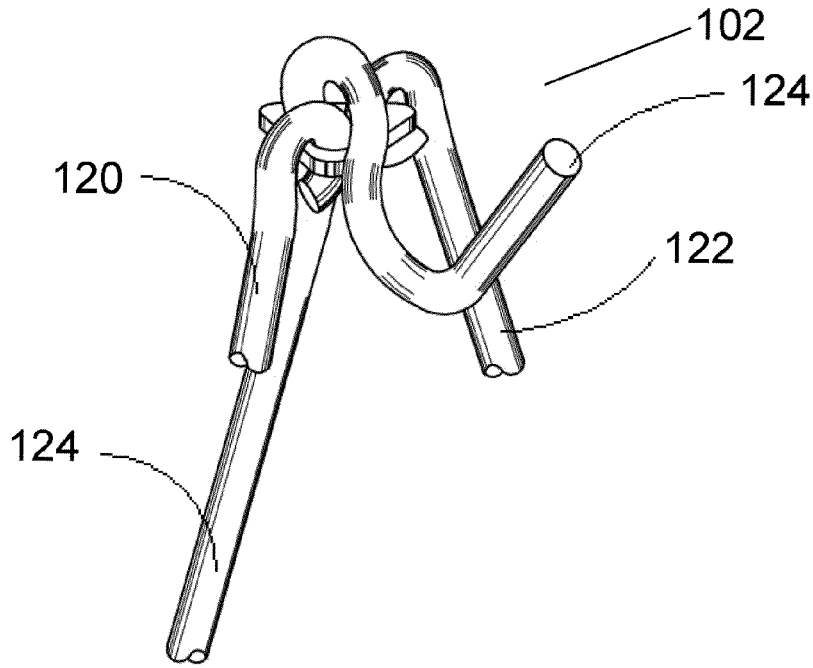
FIG. 7A is a perspective view of a fourth embodiment of the apex of an erectable or collapsible easel, in an assembled state, in accordance with the present disclosure.
Figure 7B:
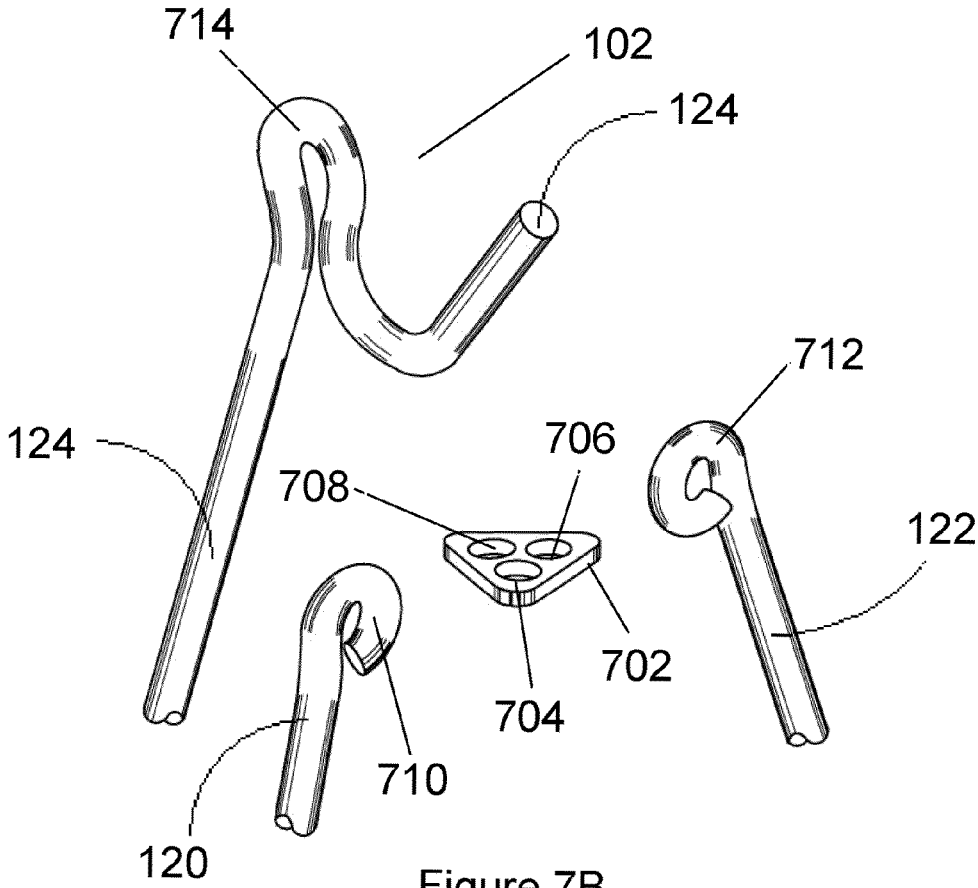
FIG. 7B is a perspective view of the fourth embodiment of the apex of an erectable or collapsible easel, in an unassembled state, in accordance with the present disclosure.

FIG. 7A is a perspective view of a fourth embodiment of the apex 100 of an erectable or collapsible easel, in an assembled state, in accordance with the present disclosure. FIG. 7B is a perspective view of the fourth embodiment of the apex 100 in an unassembled state, in accordance with the present disclosure. In the fourth embodiment, the apex 100 comprises a triangular rigid plate 702. The triangular rigid plate 702 comprises a first bore hole 704, a second bore hole 706, and a third bore hole 708. the first end of the first leg 120 comprises a first bend portion 710 that pivotably engages the triangular rigid plate 702 through the first bore hole 704. The first end of the second leg 122 comprises a second bend portion 712 that pivotably engages the triangular rigid plate 702 through the second bore hole 706. The first end of the third leg 124 comprises a third bend portion 714 that pivotably engages the triangular rigid plate 702 through the third bore hole 708.

Figure 8A:
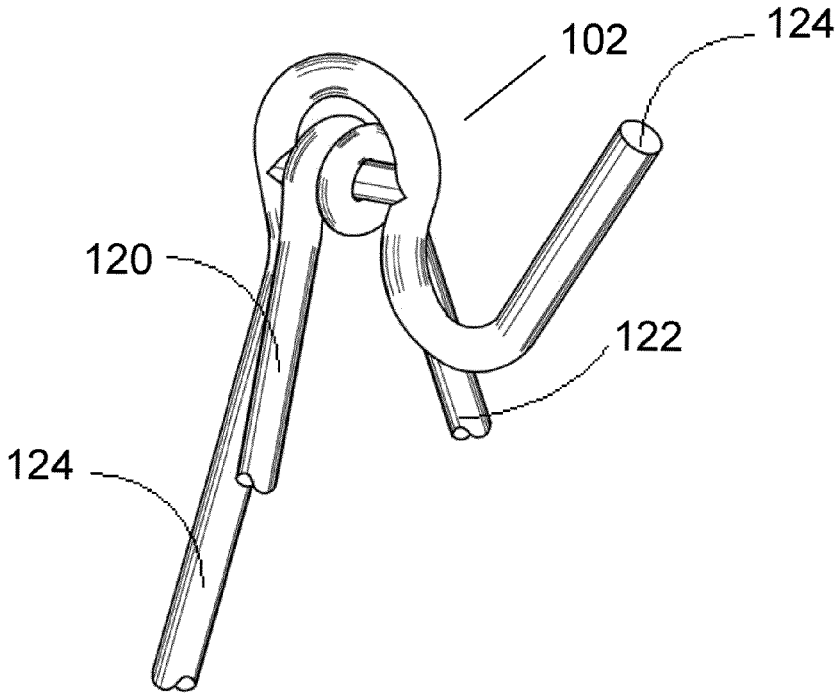
FIG. 8A is a perspective view of a fifth embodiment of the apex of an erectable or collapsible easel, in an assembled state, in accordance with the present disclosure.
Figure 8B:
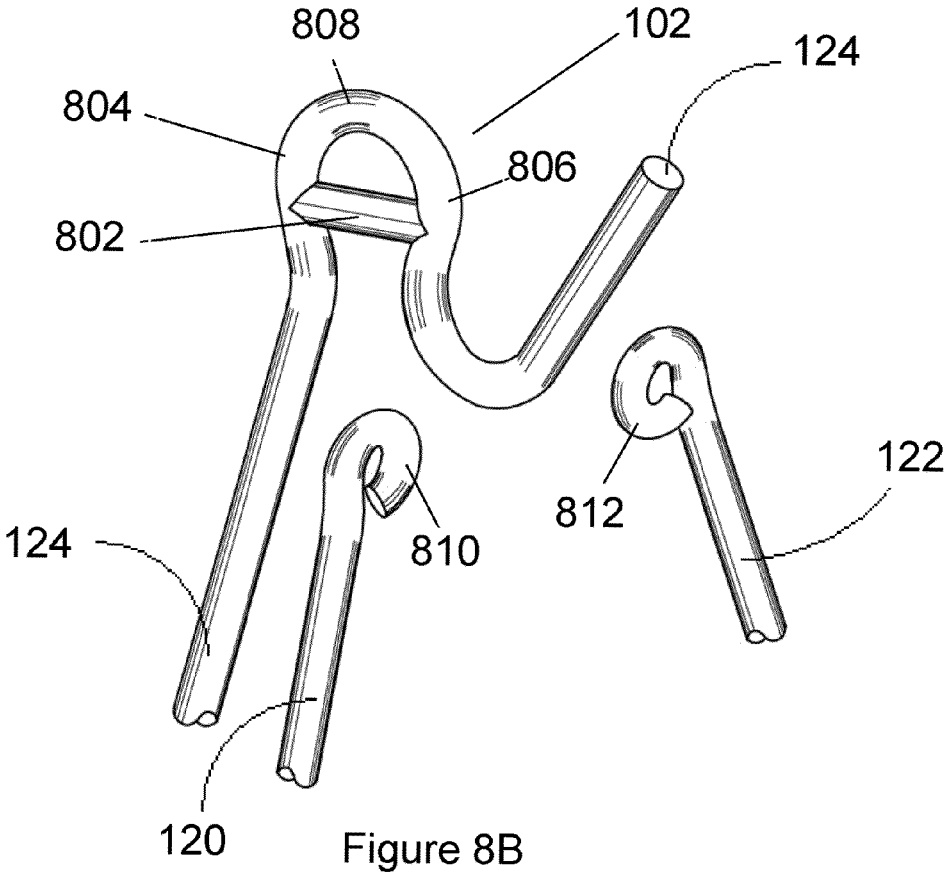
FIG. 8B is a perspective view of the fifth embodiment of the apex of an erectable or collapsible easel, in an unassembled state, in accordance with the present disclosure.

FIG. 8A is a perspective view of a fifth embodiment of the apex 102 of an erectable or collapsible easel 100, in an assembled state, in accordance with the present disclosure. FIG. 8B is a perspective view of the fifth embodiment of the apex 102 in an unassembled state, in accordance with the present disclosure. In the fifth embodiment, the apex 102 comprises an interconnect 802 that joins a first portion 804 and a second portion 806 of a first bend 808 in a first end of the third leg 124. The first end of the first leg 120 comprises a second bend 810 that pivotably engages the interconnect 802. The first end of the second leg 122 comprises a third bend 812 that pivotably engages the interconnect 802.

Figure 9A:
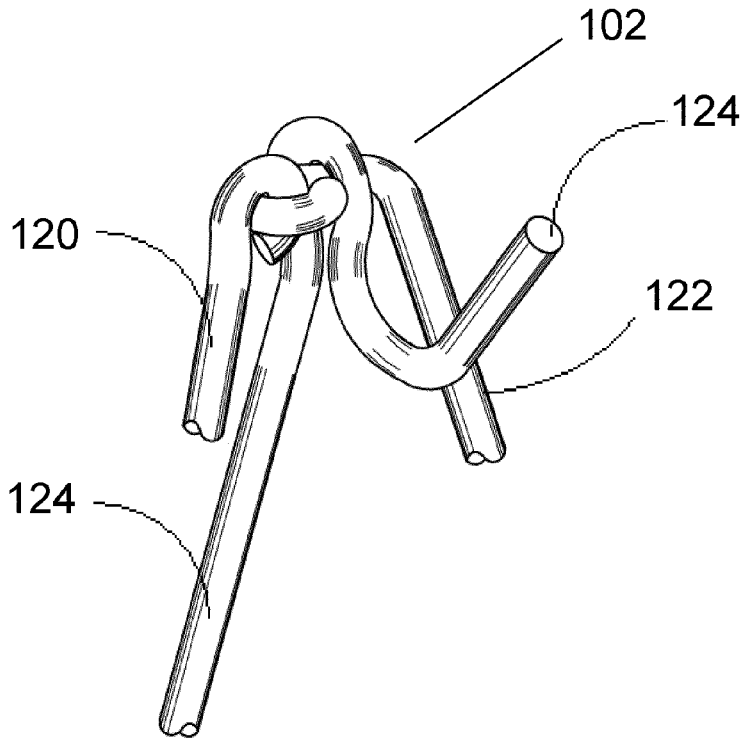
FIG. 9A is a perspective view of a sixth embodiment of the apex of an erectable or collapsible easel, in an assembled state, in accordance with the present disclosure.
Figure 9B:
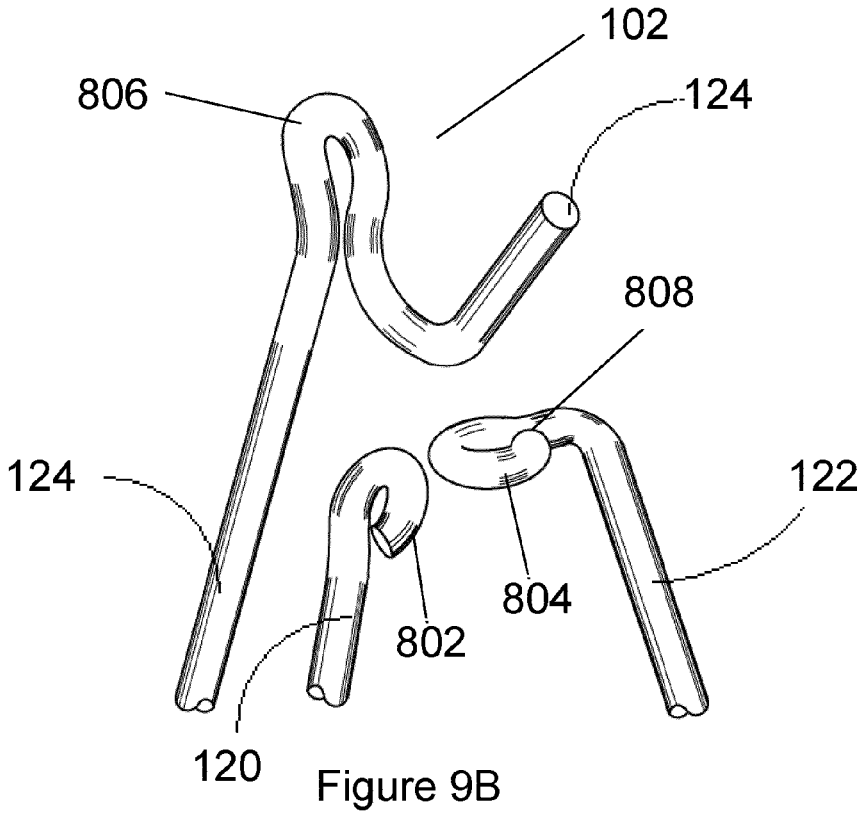
FIG. 9B is a perspective view of the sixth embodiment of the apex of an erectable or collapsible easel, in an unassembled state, in accordance with the present disclosure.

FIG. 9A is a perspective view of a sixth embodiment of the apex 102 of an erectable or collapsible easel 100, in an assembled state, in accordance with the present disclosure. FIG. 9B is a perspective view of the sixth embodiment of the apex 102 in an unassembled state, in accordance with the present disclosure. In the sixth embodiment, the first end of the first leg 120 comprises a first bend 802. The first end of the second leg 122 comprises a second bend 804. The first bend 802 and the second bend 804 are interlocked with respect to each other, thereby pivotably interconnecting the first leg 120 and the second leg 122. The first end of the third leg 124 comprises third bend 806 that engages the second leg 122 at a position 808 proximate to the second bend 804, thereby pivotably attaching the third leg 124 to the first leg 120 and the second leg 122.

Figure 10:
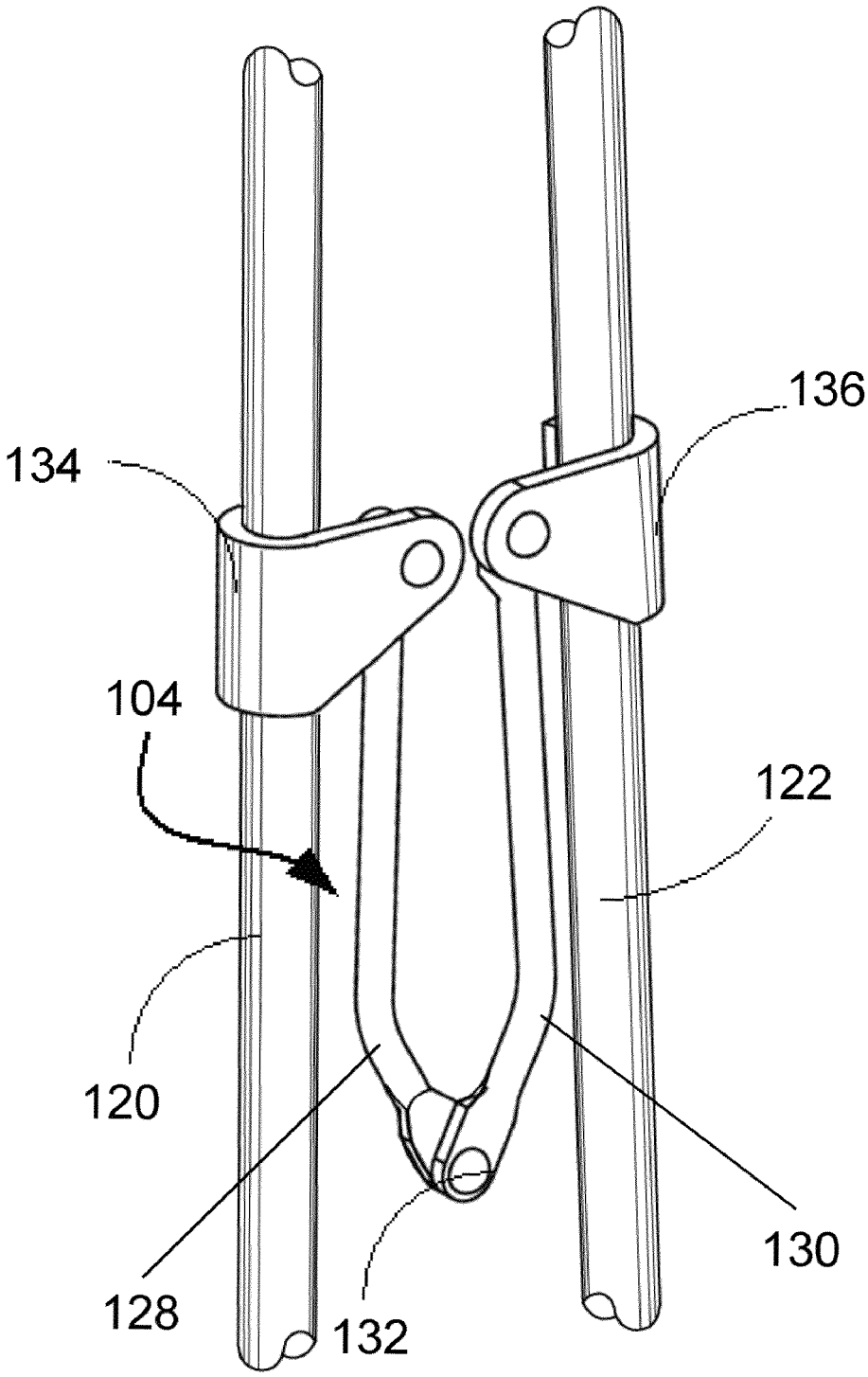
FIG. 10 is a perspective view of a first embodiment of a reinforcing member of an erectable or collapsible easel, in a collapsed state, in accordance with the present disclosure.
Figure 11A:
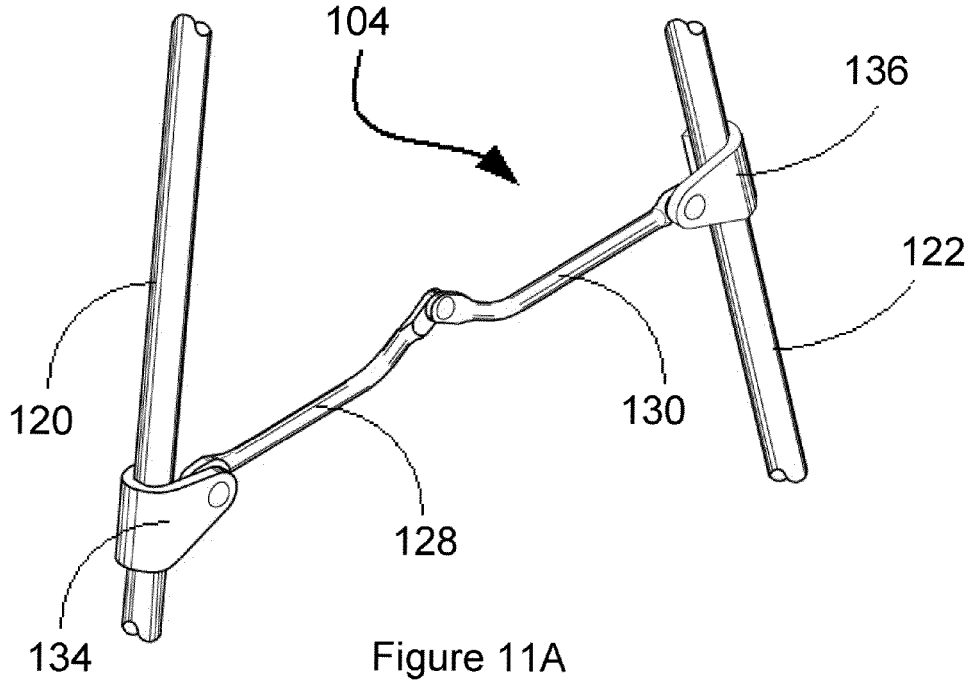
FIG. 11A is a perspective view of the first embodiment of a reinforcing member of an erectable or collapsible easel, in an open state, in accordance with the present disclosure.
Figure 11B:
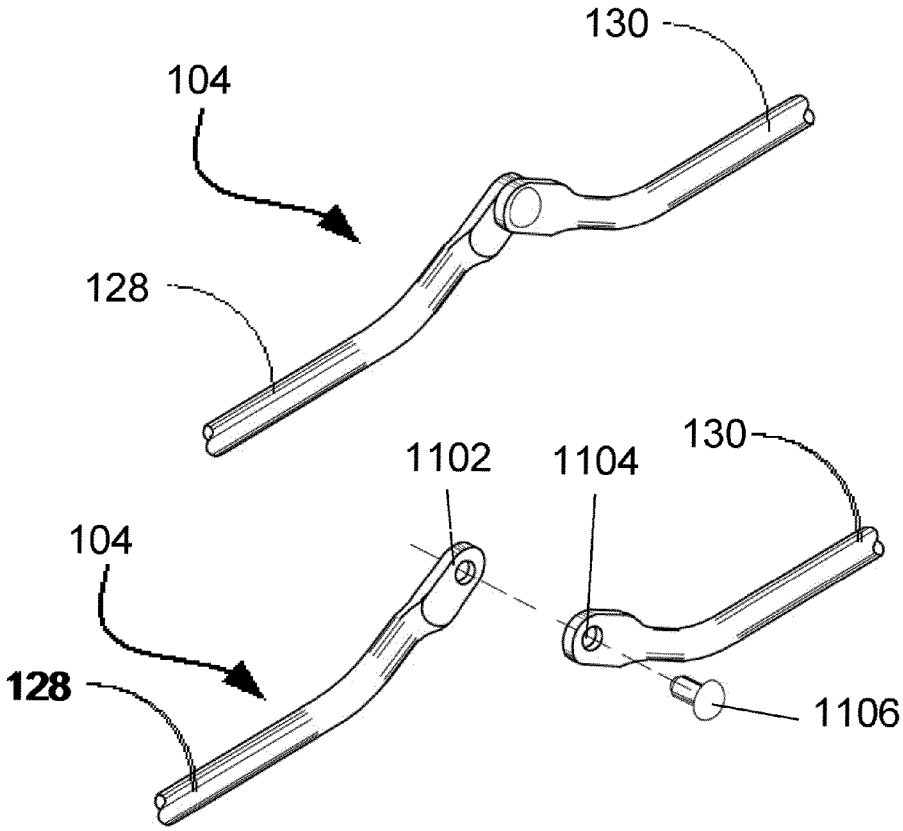
FIG. 11B is a blow up view of the first embodiment of the reinforcing member depicted in FIG. 11A, both in an assembled and unassembled state, in accordance with the present disclosure.

FIG. 10 is a perspective view of a first embodiment of a reinforcing member 104 of an erectable or collapsible easel 100, in a collapsed state, in accordance with the present disclosure. FIG. 11A is a perspective view of the first embodiment of a reinforcing member 104 of an erectable or collapsible easel 100, in an open state, in accordance with the present disclosure. FIG. 11B is a blow up view of the first embodiment of the reinforcing member depicted in FIG. 11A, both in an assembled and unassembled state, in accordance with the present disclosure. In this first embodiment, a first end of the first reinforcing arm 128 is opposed to an end of the first reinforcing arm that is attached to the first attachment point of the first leg. As collectively illustrated in FIGS. 11A and 11B, this first end of the first reinforcing arm 128 comprises a first bore hole 1102. As further collectively illustrated in FIGS. 11A and 11B, the first end of the second reinforcing arm 130 is opposed to an end of the second reinforcing arm 130 that is attached to the first attachment point of the second leg 122. The first end of the second reinforcing arm 130 comprises a second bore 1104. The pivoting mechanism of the reinforcing member 104 is a pivot pin 1106 that engages the first reinforcing arm 128 through the first bore hole 1102 and engages the second reinforcing arm 130 through the second bore hole 1104, thereby pivotably joining the first and second reinforcing arms of the reinforcing member 104.

Figure 12:
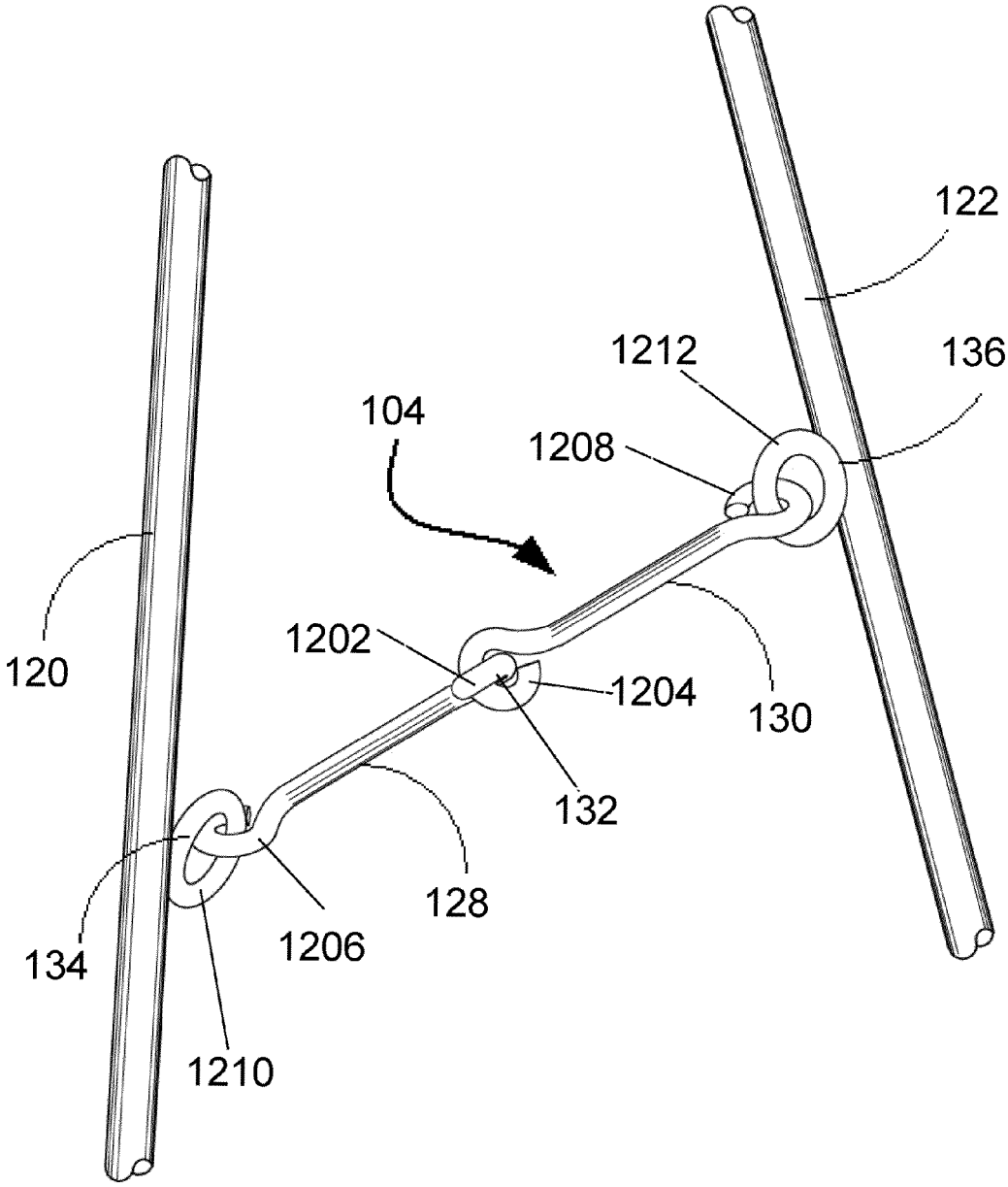
FIG. 12 is a perspective view of a second embodiment of a reinforcing member of an erectable or collapsible easel, in an open state, in accordance with the present disclosure.

FIG. 12 is a perspective view of a second embodiment of a reinforcing member 104 of an erectable or collapsible easel 100, in an open state, in accordance with the present disclosure. In this second embodiment, a first end of the first reinforcing arm 128 is opposed to an end of the first reinforcing arm that is attached to the first attachment point 134 of the first leg 120. The first end of the first reinforcing arm 128 comprises a first attachment hook 1202. A first end of the second reinforcing arm 130 is opposed to an end of the second reinforcing arm 130 that is attached to the first attachment point 136 of the second leg 122. The first end of the second reinforcing arm 130 comprises a second attachment hook 1204. The first attachment hook 1202 interlocks with the second attachment hook 1204 to form the pivoting mechanism 132 that pivotably joins the first and second reinforcing arms of the reinforcing member 104. The end of the first reinforcing arm 128 that is attached to the first attachment point 134 of the first leg 120 comprises a third attachment hook 1206. The end of the second arm 130 that is attached to the first attachment point 136 of the second leg 122 comprises a fourth attachment hook 1208. The first attachment point 134 of the first leg 120 comprises a first attachment loop 1210. The first attachment point 136 of the second leg 122 comprises a second attachment loop 1212. The third attachment hook 1206 is engaged with the first attachment loop 1210 thereby pivotably attaching the first reinforcing arm 128 to the first leg 120. The fourth attachment hook 1208 is engaged with the second attachment loop 1212 thereby pivotably attaching the second reinforcing arm 130 to the second leg 122.

Figure 13:
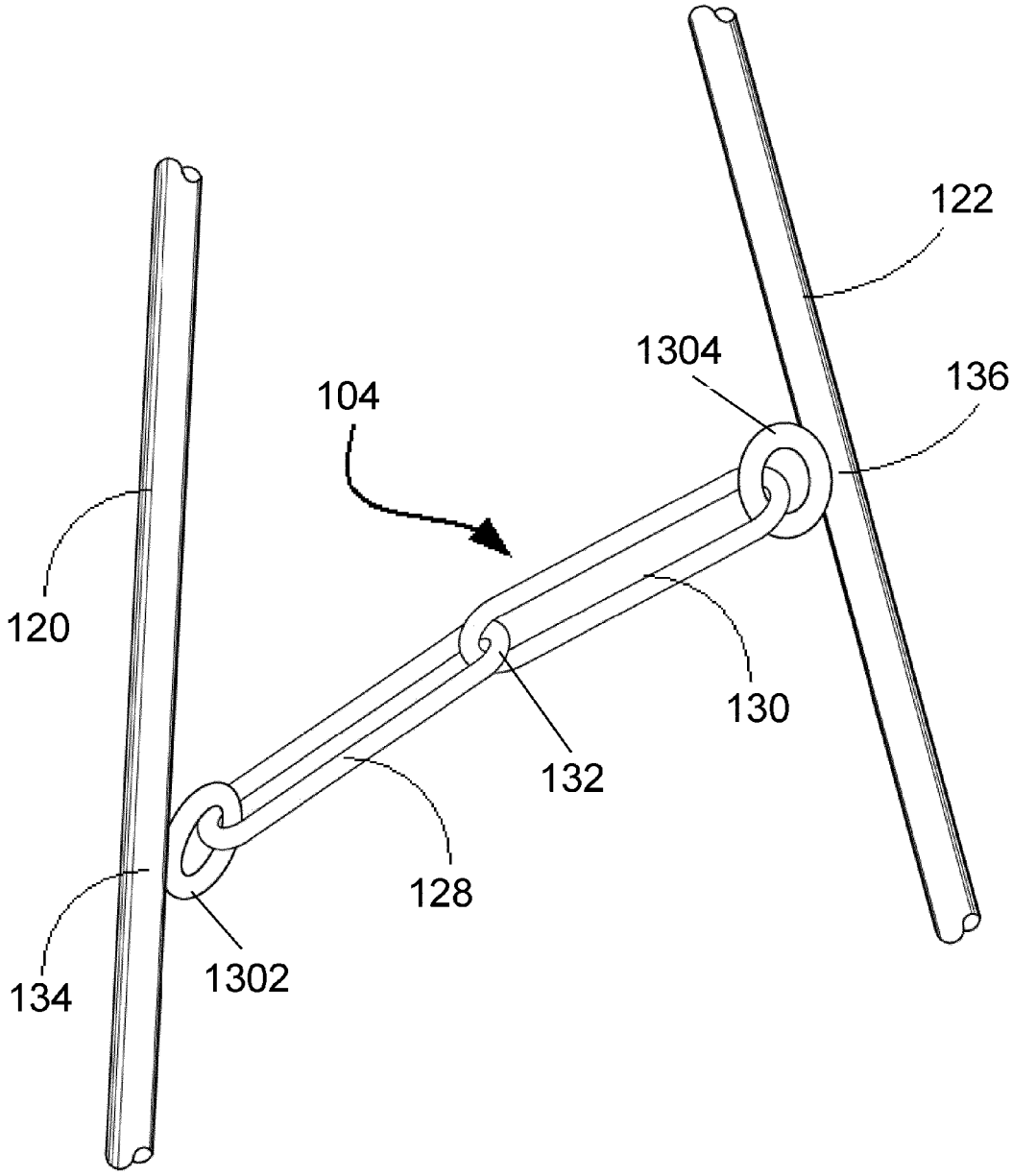
FIG. 13 is a perspective view of a third embodiment of a reinforcing member of an erectable or collapsible easel, in an open state, in accordance with the present disclosure.

FIG. 13 is a perspective view of a third embodiment of a reinforcing member 104 of an erectable or collapsible easel 100, in an open state, in accordance with the present disclosure. In this third embodiment, the first reinforcing arm 128 comprises a first reinforcing loop and the second reinforcing arm comprises a second reinforcing loop. The first reinforcing loop interlocks with the second reinforcing loop to form the pivoting mechanism 132 that pivotably joins the first and second reinforcing arms. The first attachment point 134 of the first leg 120 comprises a first attachment loop 1302. The first attachment point 136 of the second leg 122 comprises a second attachment loop 1304. The first reinforcing loop interlocks with the first attachment loop 1302 thereby pivotably attaching the first reinforcing arm 128 to the first leg 120. The second reinforcing loop interlocks with the second attachment loop 1304 thereby pivotably attaching the second reinforcing arm 130 to the second leg 122.

Figure 14A:
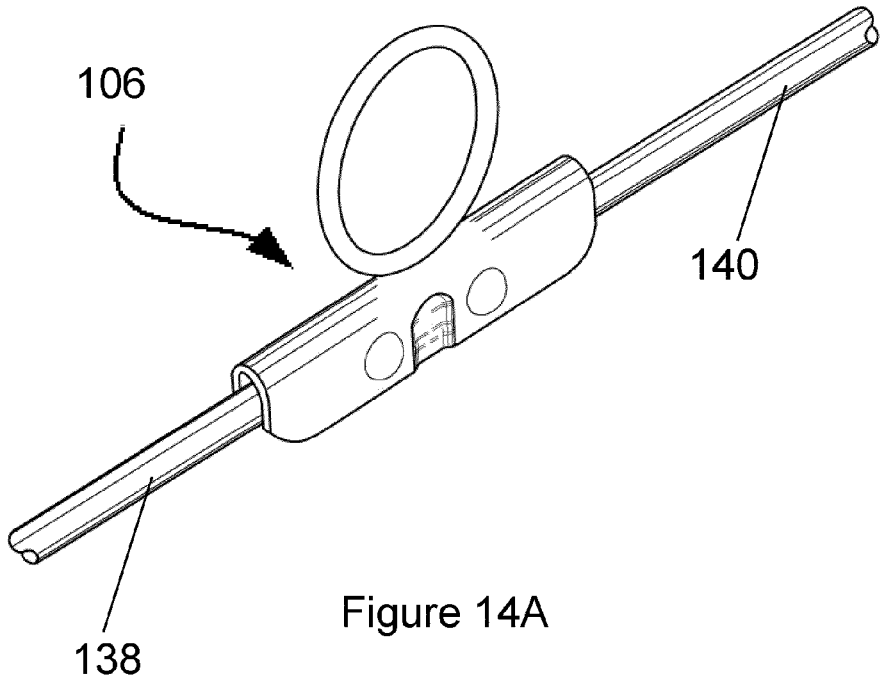
FIG. 14A is a perspective view of a first embodiment of an interlocking mechanism of a bracing assembly of an erectable or collapsible easel, in an assembled open state, in accordance with the present disclosure.
Figure 14B:
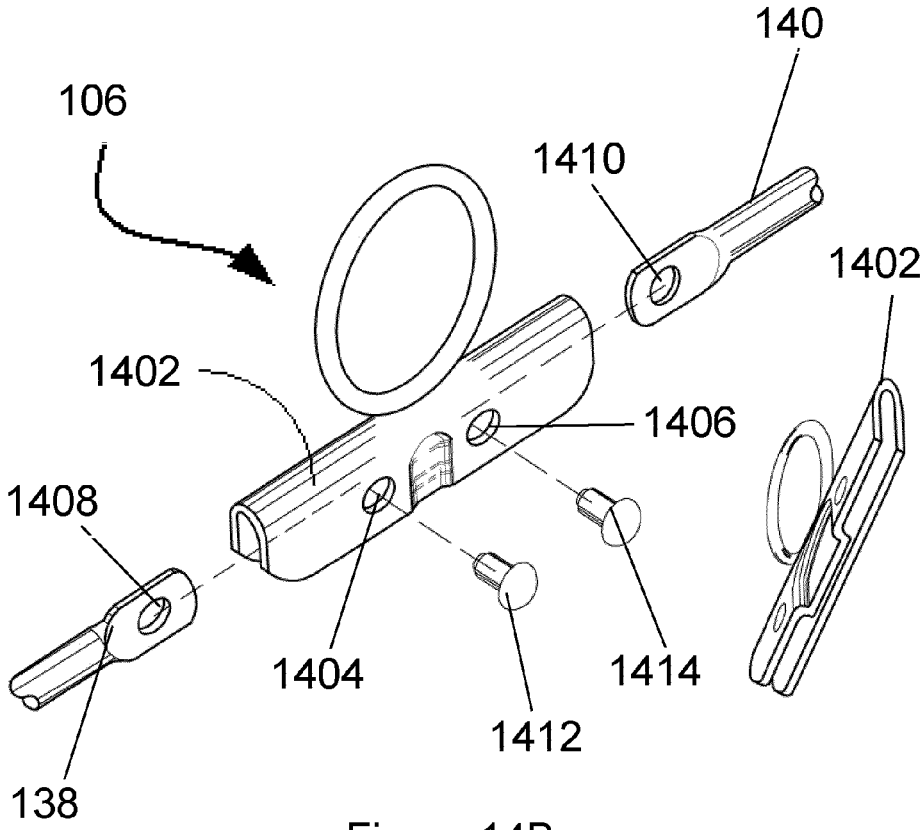
FIG. 14B is a perspective view of a first embodiment of an interlocking mechanism of a bracing assembly of an erectable or collapsible easel, in an unassembled state, in accordance with the present disclosure.

FIG. 14A is a perspective view of a first embodiment of an interlocking mechanism 106 of a bracing assembly 126 of an erectable or collapsible easel 100, in an assembled open state, in accordance with the present disclosure. FIG. 14B is a perspective view of the first embodiment of the interlocking mechanism 106 in an unassembled state, in accordance with the present disclosure. In the first embodiment of the bracing assembly, the interlocking mechanism 106 comprises a reinforcement member 1402. The reinforcement member comprises a first bore hole 1404 and a second bore hole 1406. An end of the first alpha arm 138 that is opposite an end of the first alpha arm that is fixedly attached to the second attachment point 110 of the first leg 120 comprises a third bore hole 1408. An end of the second alpha arm 140 that is opposite an end of the second alpha arm that is fixedly attached to the second attachment point 142 of the second leg 122 comprises a fourth bore hole 1410. A first pivot pin 1412 engages the reinforcement member 1402 through the first bore hole 1404 and engages the first alpha arm 138 through the third bore hole 1408, thereby pivotably joining the interlocking mechanism 106 and the first alpha arm 138. A second pivot pin 1414 engages the reinforcement member 1420 through the second bore hole 1406 and engages the second alpha arm 140 through the third bore hole 1410, thereby pivotably joining the interlocking mechanism 1402 and the second alpha arm 140.

Figure 15A:
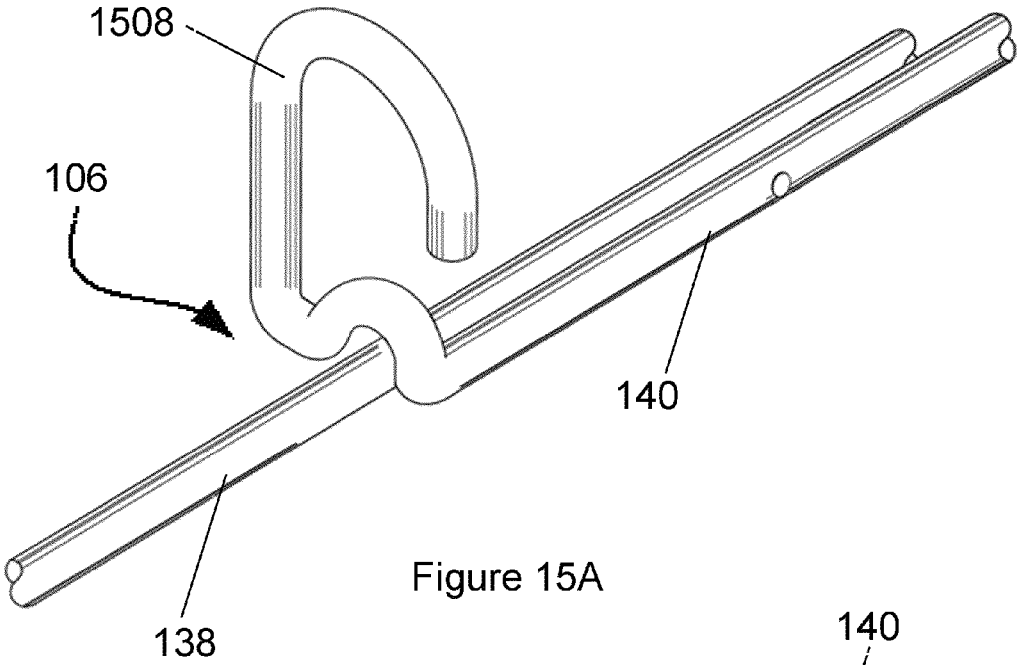
FIG. 15A is a perspective view of a second embodiment of an interlocking mechanism of a bracing assembly of an erectable or collapsible easel, in an assembled open state, in accordance with the present disclosure.
Figure 15B:
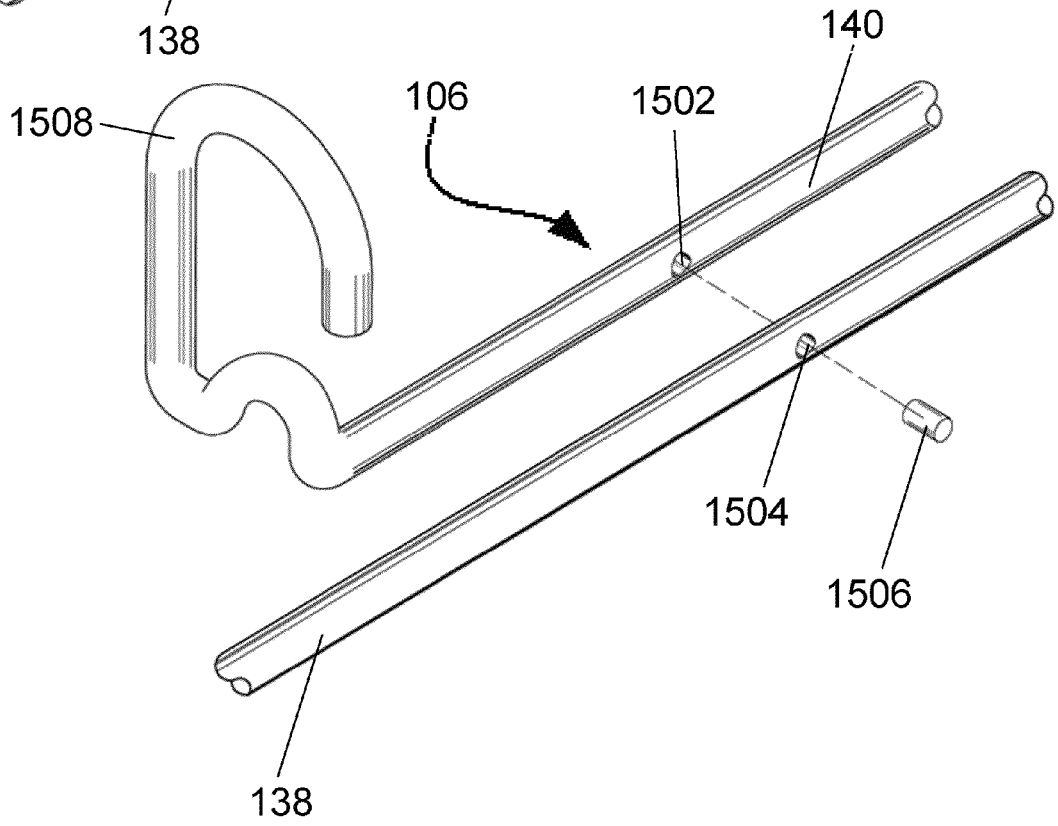
FIG. 15B is a perspective view of the second embodiment of an interlocking mechanism of a bracing assembly of an erectable or collapsible easel, in an unassembled state, in accordance with the present disclosure.
Figure 16A:
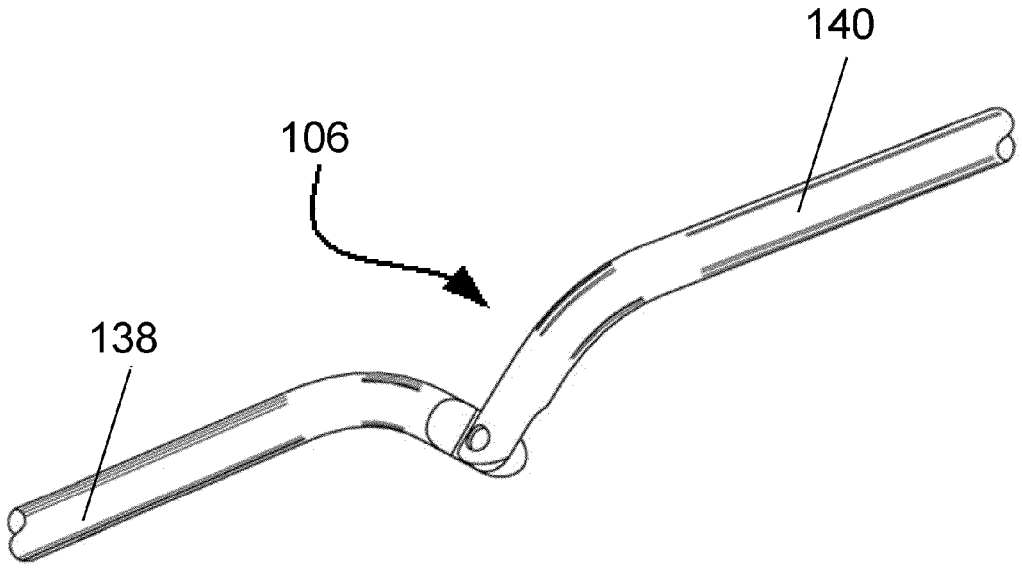
FIG. 16A is a perspective view of a third embodiment of an interlocking mechanism of a bracing assembly of an erectable or collapsible easel, in an assembled open state, in accordance with the present disclosure.
Figure 16B:
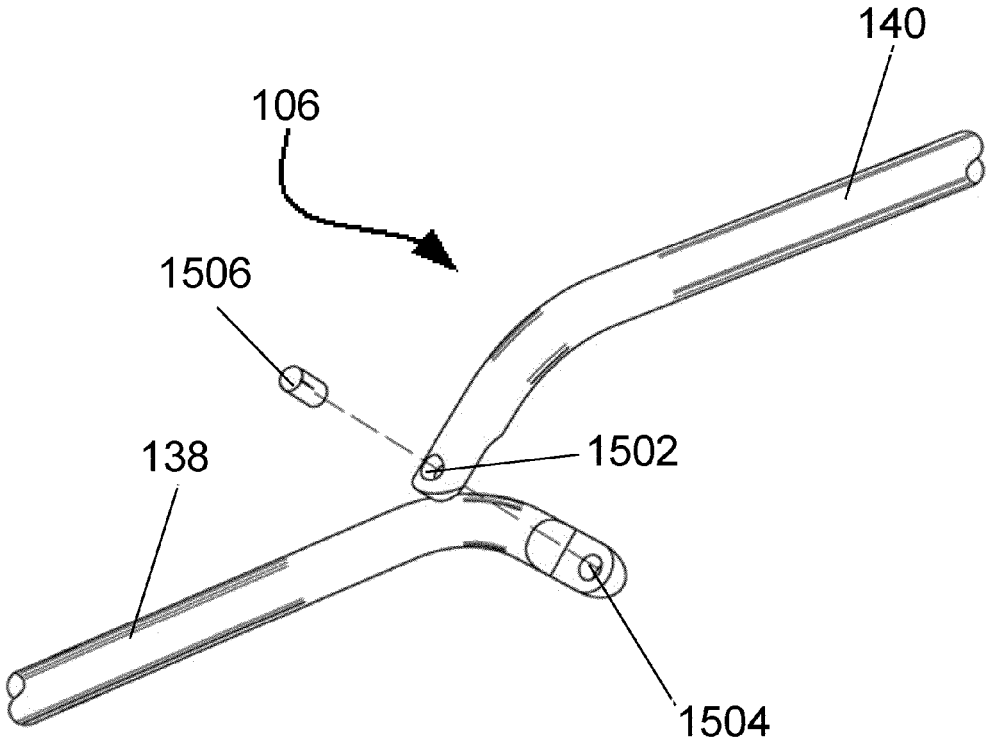
FIG. 16B is a perspective view of the third embodiment of an interlocking mechanism of a bracing assembly of an erectable or collapsible easel, in an unassembled state, in accordance with the present disclosure.

FIG. 15A is a perspective view of a second embodiment of an interlocking mechanism 106 of a bracing assembly 126 of an erectable or collapsible easel 100, in an assembled open state, in accordance with the present disclosure. FIG. 15B is a perspective view of the second embodiment of the interlocking mechanism 106 in an unassembled state, in accordance with the present disclosure. FIG. 16A is a perspective view of a third embodiment of an interlocking mechanism 106 of a bracing assembly 126 of an erectable or collapsible easel 100, in an assembled open state, in accordance with the present disclosure. FIG. 16B is a perspective view of the third embodiment of the interlocking mechanism 106 in an unassembled state, in accordance with the present disclosure. Referring to FIGS. 15 and 16, an end of the first alpha arm 138 that is opposite an end of the first alpha arm 138 that is fixedly attached to the second attachment point 110 of the first leg 120 comprises a first bore hole 1504. An end of the second alpha arm 10 that is opposite an end of the second alpha arm that is fixedly attached to the second attachment point 142 of the second leg 122 comprises a second bore hole 1502. The interlocking mechanism 106 is a pivot pin 1506 that engages the first alpha arm 1504 through the first bore hole 1504 and engages the second alpha arm 140 through the second bore hole 1502, thereby pivotably joining the first alpha arm 138 and the second alpha arm 140 to each other. Referring to FIG. 15, in some embodiments second alpha arm 140 has a handle 1508 as shown. However, in preferred embodiments, first alpha arm 138 has the handle 1508 rather than second alpha arm 140.

Figure 17A:
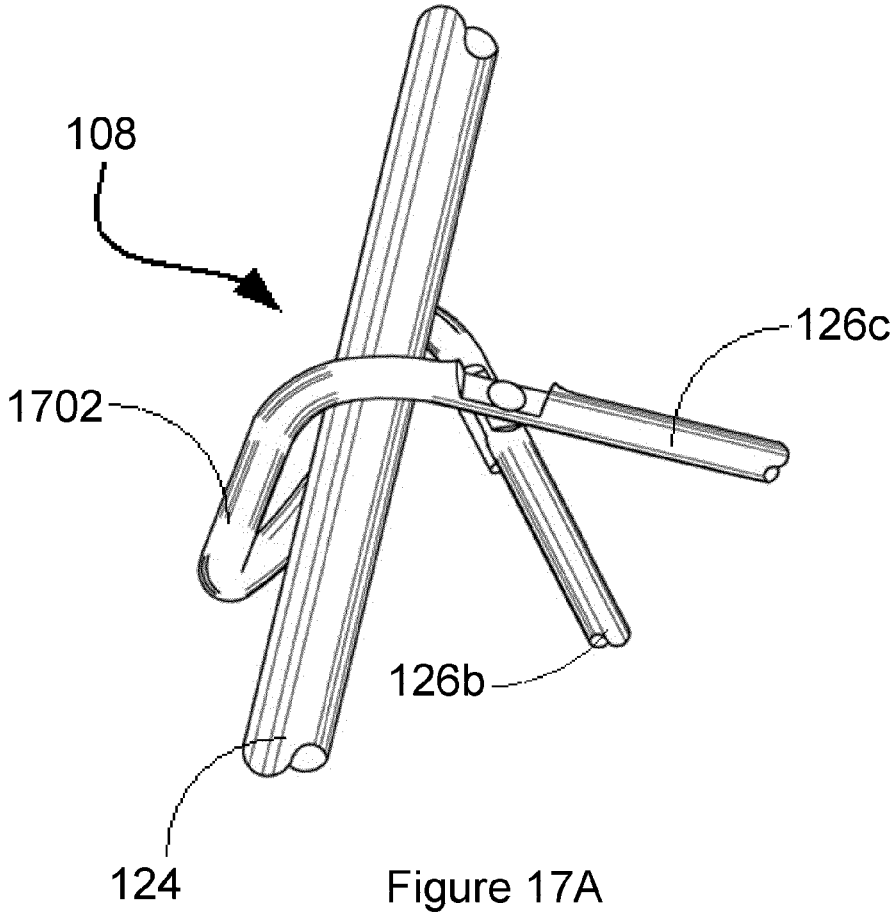
FIG. 17A is a perspective view of a first embodiment of a slidable interconnection of a bracing assembly and a rear easel leg of an erectable or collapsible easel, in an assembled state, in accordance with the present disclosure.
Figure 17B:
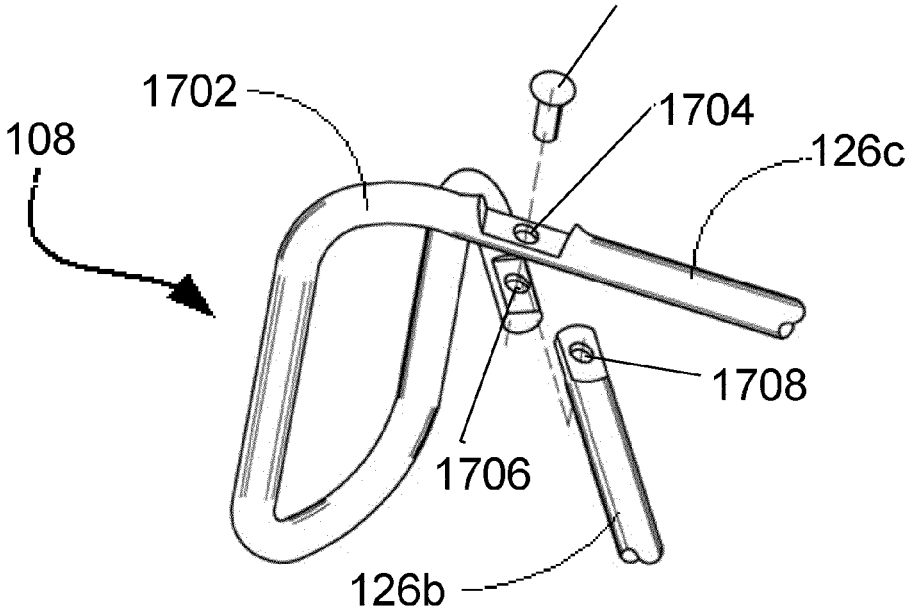
FIG. 17B is a perspective view of the first embodiment of a slidable interconnection of a bracing assembly and a rear easel leg of an erectable or collapsible easel, in an unassembled state, in accordance with the present disclosure.

FIG. 17A is a perspective view of a first embodiment of a slidable interconnection 108 of a bracing assembly 126 and a rear (third) easel leg 124 of an erectable or collapsible easel 100, in an assembled state, in accordance with the present disclosure. FIG. 17B is a perspective view of the first embodiment of the slidable interconnection 108 of a bracing assembly 126 and a rear (third) easel leg 124 in an unassembled state, in accordance with the present disclosure. In the first embodiment of the slidable interconnection 108, the first end of the gamma support member 126*c* comprises a bend 1702 that wraps around the third leg 124. The first end of the gamma support member 126*c* comprises a first bore hole 1704 in a first portion of the bend 170 and a second bore hole 1706 in a second portion of the bend 1702. The second end of the beta support member 126*b* comprises a third bore hole 1706. A pivot pin engages the gamma support member 126 through the first bore hole 1704 and the second bore hole 1706 and engages the beta support member through the third bore hole, thereby (i) attaching the second end of the beta support member and the first end of the gamma support member to each other, (ii) slidably attaching the second end of the beta support member 126*b* to the third leg 124 and (iii) slidably attaching the first end of the gamma support member 126*c* to the third leg 124.

Figure 18A:
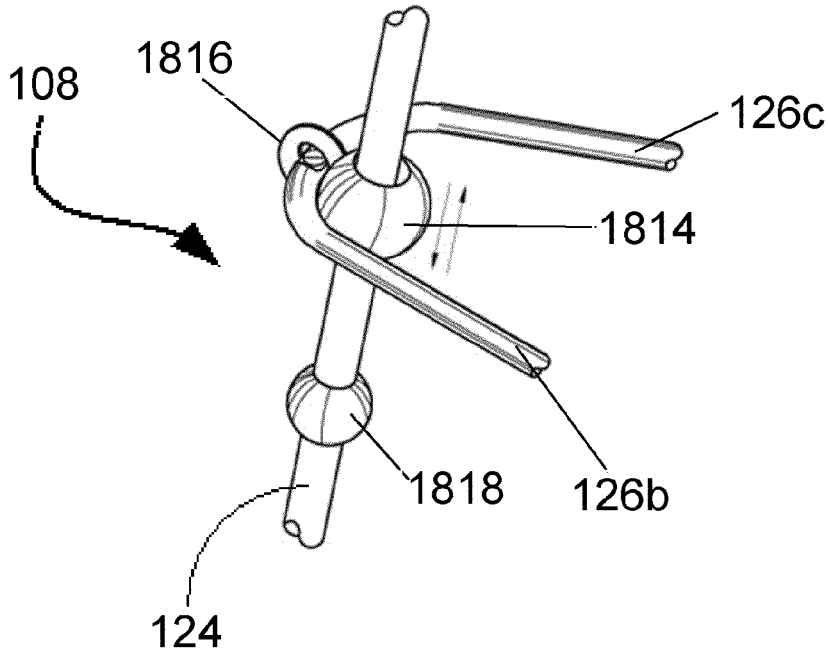
FIG. 18A is a perspective view of a second embodiment of a slidable interconnection of a bracing assembly and a rear easel leg of an erectable or collapsible easel, in an assembled state, in accordance with the present disclosure.
Figure 18B:
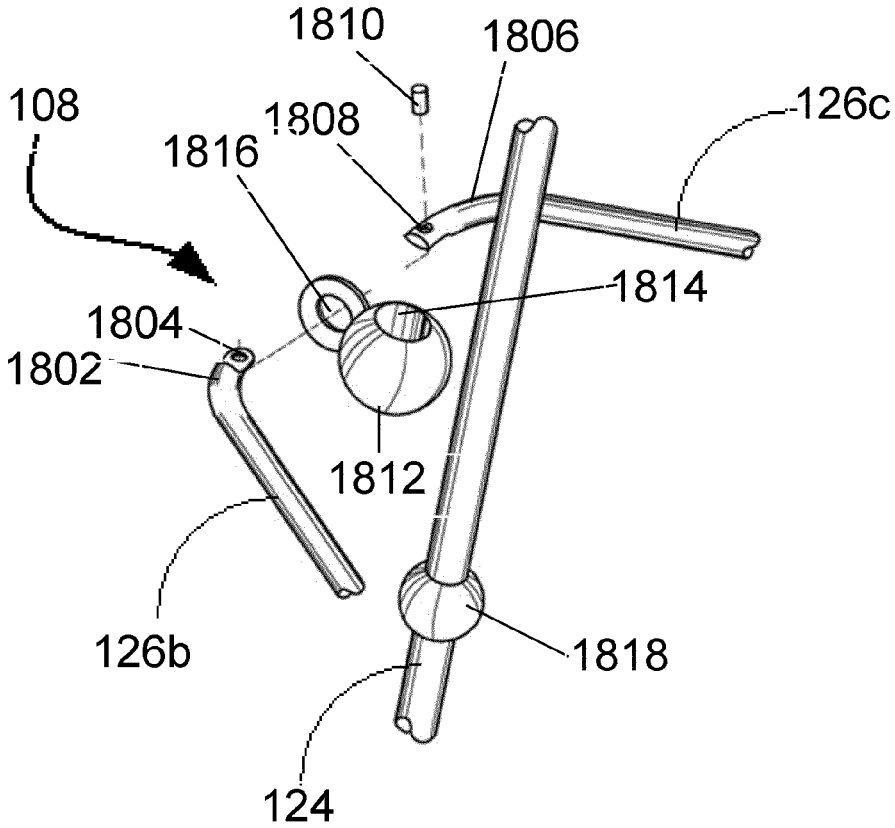
FIG. 18B is a perspective view of the second embodiment of a slidable interconnection of a bracing assembly and a rear easel leg of an erectable or collapsible easel, in an unassembled state, in accordance with the present disclosure.

FIG. 18A is a perspective view of a second embodiment of a slidable interconnection 108 of a bracing assembly 126 and a rear easel leg 124 of an erectable or collapsible easel 100, in an assembled state, in accordance with the present disclosure. FIG. 18B is a perspective view of the second embodiment of the slidable interconnection 108 in an unassembled state, in accordance with the present disclosure. In the second embodiment of the slidable interconnection, the second end of the beta support member 126*b* comprises a first bend 1802 that partially wraps around the third leg 124. The second end of the beta support member comprises a first bore hole 1804. The first end of the gamma support member 126*c* comprises a second bend 1806 that partially wraps around the third leg 124. The first end of the gamma support member 126*c* comprises a second bore hole 1808. A 1810 pivot pin engages the beta support member 126*b* through the first bore hole 1804 and engages the gamma support member 126*c* through the second bore hole 1808, thereby attaching the second end of the beta support member 126*b* and the first end of the gamma support member 126*c* to each other. The collapsible easel further comprises a bead assembly 1812. The bead assembly comprises: (i) a bead body having a bead bore 1814, and (ii) an attachment loop 1816 fixedly attached to the bead body 1814. The bead body having a bead bore 1814 is slidably engaged to the third leg 124 through the bead bore. The first bend 182 and/or the second bend 1806 passes through the attachment loop 1816 thereby slidably attaching the second end of the beta support member 126*b* to the third leg 124 and slidably attaching the first end of the gamma support member 126*c* to the third leg 124. The easel further comprises a bead stop 1818 mounted on the third leg 124. The bead stop 1818 limits a range that the bead body having a bead bore 1814 can traverse on the third leg 124.

Figure 19A:
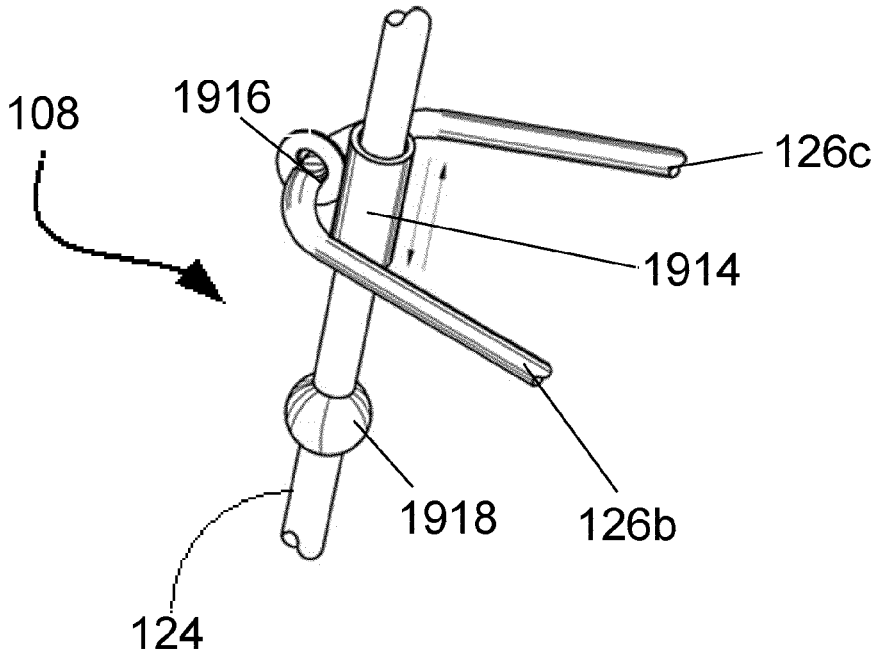
FIG. 19A is a perspective view of a third embodiment of a slidable interconnection of a bracing assembly and a rear easel leg of an erectable or collapsible easel, in an assembled state, in accordance with the present disclosure.
Figure 19B:
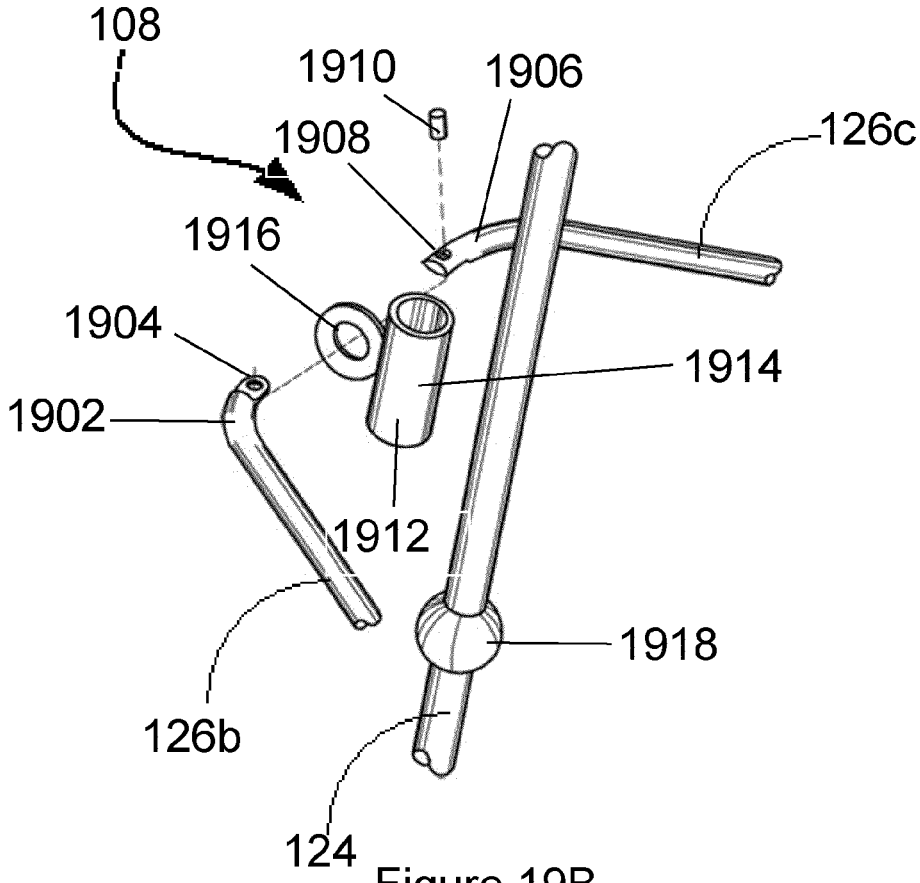
FIG. 19B is a perspective view of the third embodiment of a slidable interconnection of a bracing assembly and a rear easel leg of an erectable or collapsible easel, in an unassembled state, in accordance with the present disclosure.

FIG. 19A is a perspective view of a third embodiment of a slidable interconnection 108 of a bracing assembly 126 and a rear (third) easel leg 124 of an erectable or collapsible easel 100, in an assembled state, in accordance with the present disclosure. FIG. 19B is a perspective view of the third embodiment of the slidable interconnection 108 in an unassembled state, in accordance with the present disclosure. In the third embodiment of the slidable interconnection 108, the second end of the beta support member 126*b* comprises a first bend 1902 that partially wraps around the third leg 124. The second end of the beta support member 126*b* comprises a first bore hole 1904. The first end of the gamma support member 126*c* comprises a second bend 1906 that partially wraps around the third leg 124. The first end of the gamma support member 126*c* comprises a second bore hole 1908. A pivot pin 1910 engages the beta support member 126*b* through the first bore hole 1904 and engages the gamma support member 126*c* through the second bore hole 1908, thereby attaching the second end of the beta support member 126*b* and the first end of the gamma support member 126*c* to each other. The collapsible easel further comprises a tube assembly 1912. The tube assembly 1912 comprises (i) a tube body 1914 having a tube bore and (ii) an attachment loop 1916 fixedly attached to the tube body. The tube body 1914 is slidably engaged to the third leg 124 through the tube bore. The first bend 1902 and/or the second bend 1906 passes through the attachment loop 1916 thereby slidably attaching the second end of the beta support member 126*b* to the third leg 124 and slidably attaching the first end of the gamma support member 126*c* to the third leg 124. The collapsible easel 100 further comprises a tube stop 1918 mounted on the third leg 124. The tube stop 1918 limits a range that the tube body 1912 can traverse on the third leg 124.

Figure 20A:
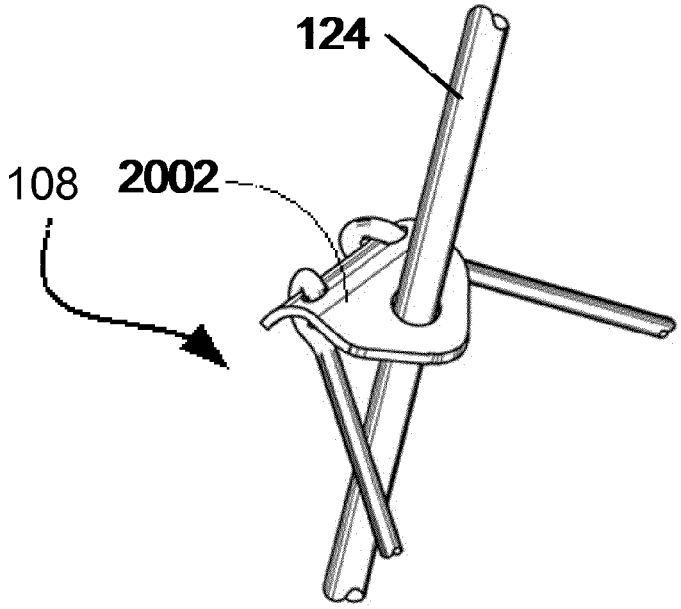
FIG. 20A is a perspective view of a fourth embodiment of a slidable interconnection of a bracing assembly and a rear easel leg of an erectable or collapsible easel, in an assembled state, in accordance with the present disclosure.
Figure 20B:
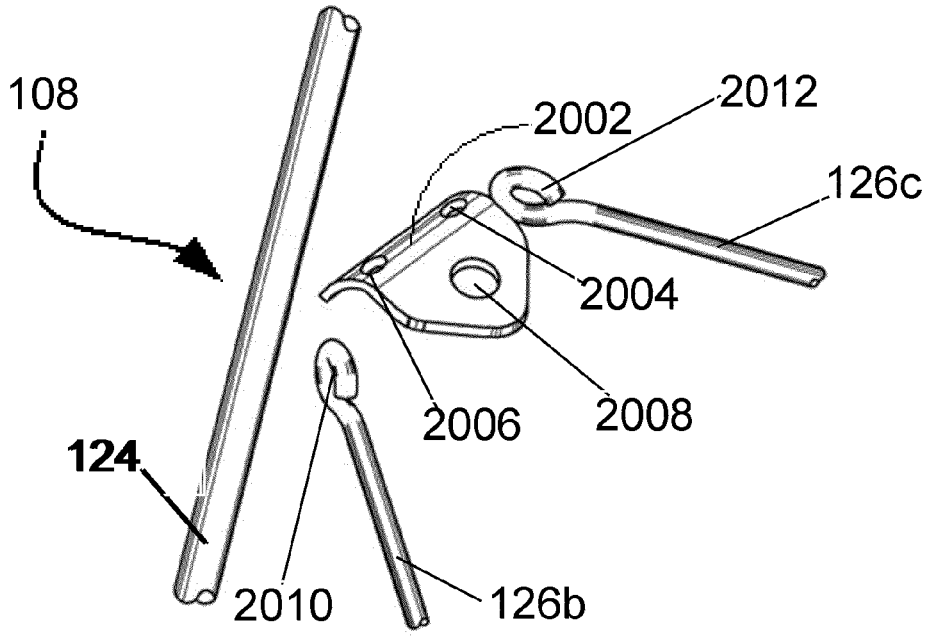
FIG. 20B is a perspective view of the fourth embodiment of a slidable interconnection of a bracing assembly and a rear easel leg of an erectable or collapsible easel, in an unassembled state, in accordance with the present disclosure.

FIG. 20A is a perspective view of a fourth embodiment of a slidable interconnection 108 of a bracing assembly 126 and a rear easel leg 124 of an erectable or collapsible easel 100, in an assembled state, in accordance with the present disclosure. FIG. 20B is a perspective view of the fourth embodiment of the slidable interconnection 108 in an unassembled state, in accordance with the present disclosure. The fourth embodiment of the slidable interconnection 108 includes a sliding plate 2002 having a first bore hole 2008, a second bore hole 2006, and a third bore hole 2004. The sliding plate 2002 is slidably engaged to the third leg 124 through the first bore hole 2008. The second end of the beta support member 126*b* comprises a first bend 2010 that passes through the second bore hole 2006. The first end of the gamma support member 126*c* comprises a second bend 2012 that passes through the third bore hole 2004. In this manner, the second end of the beta support member 126*b* and the first end of the gamma support member 126*c* are attached to each other, the second end of the beta support member 126*b* is slidably attached to the third leg 124, and the first end of the gamma support member 126*c* is slidably attached to the third leg 124.

Figure 21A:
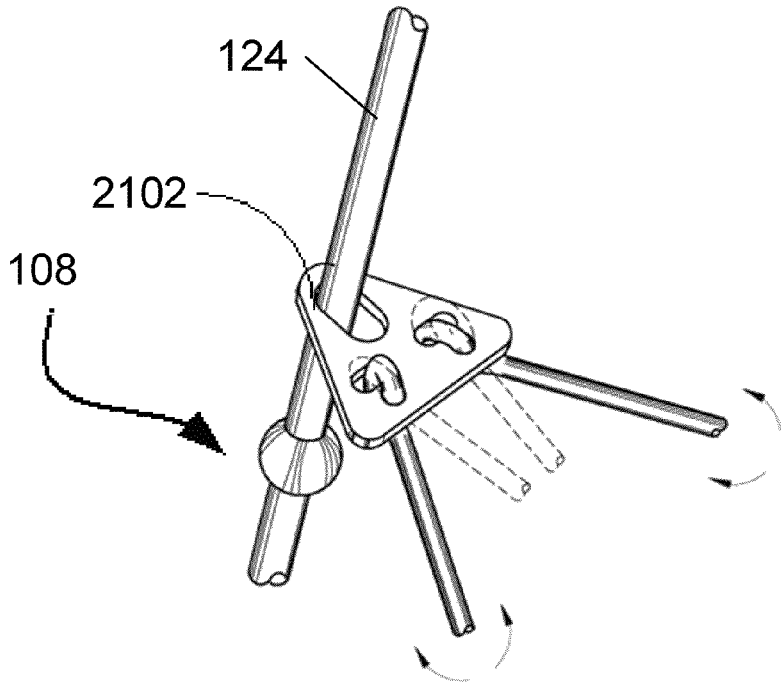
FIG. 21A is a perspective view of a fifth embodiment of a slidable interconnection of a bracing assembly and a rear easel leg of an erectable or collapsible easel, in an assembled state, in accordance with the present disclosure.
Figure 21B:
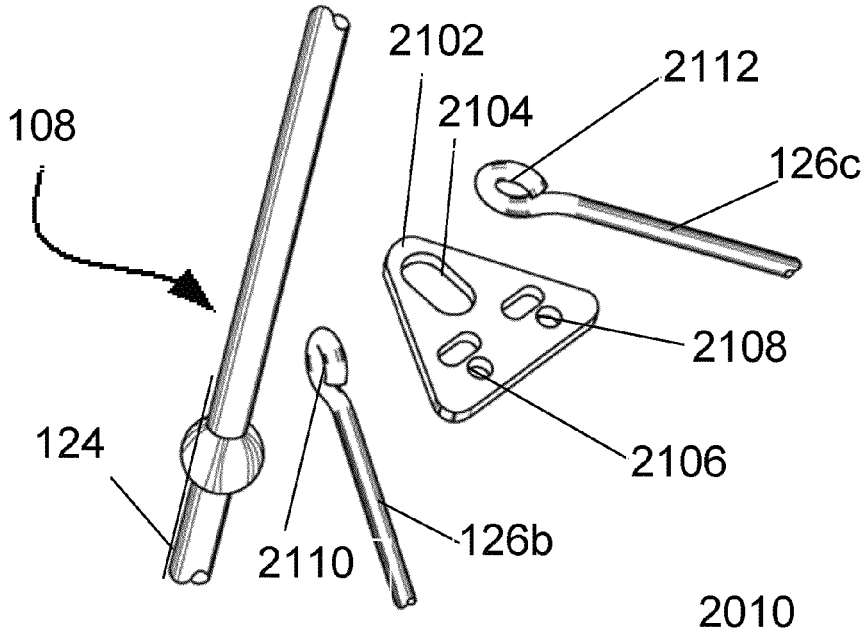
FIG. 21B is a perspective view of the fifth embodiment of a slidable interconnection of a bracing assembly and a rear easel leg of an erectable or collapsible easel, in an unassembled state, in accordance with the present disclosure.

FIG. 21A is a perspective view of a fifth embodiment of a slidable interconnection 108 of a bracing assembly 126 and the third easel leg 124 of an erectable or collapsible easel 100, in an assembled state, in accordance with the present disclosure. FIG. 21B is a perspective view of the fifth embodiment of the slidable interconnection 108 in an unassembled state, in accordance with the present disclosure. The fifth embodiment of slidable interconnection 108 comprises a sliding plate 2102 having a first bore hole 2104, a first bore hole pair 2106, and a second bore hole pair 2108. The sliding plate 2102 is slidably engaged to the third leg 124 through the first bore hole 2104. The second end of the beta support member 126*b* comprises a first bend 2110 that passes through the first bore hole pair 2106. The first end of the gamma support member 126*c* comprises a second bend 2112 that passes through the second bore hole pair 2108. In this way, the second end of the beta support member 126*b* and the first end of the gamma support member 126*c* are attached to each other, the second end of the beta support member 126*b* is slidably attached to the third leg 124, and the first end of the gamma support member 126*c* is slidably attached to the third leg 124.

Figure 22A:
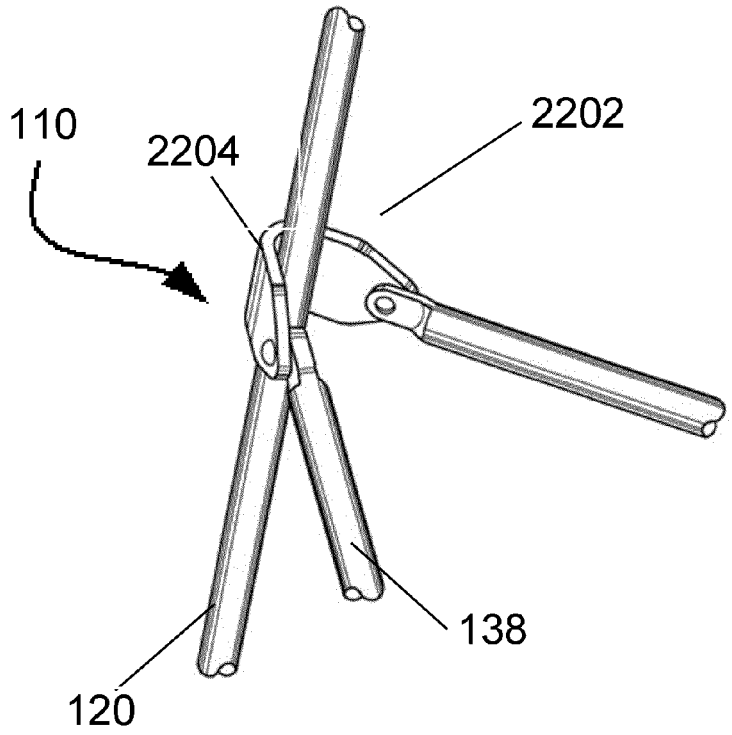
FIG. 22A is a perspective view of a first embodiment of a fixedly mounted pivotable interconnection of a bracing assembly and a forward easel leg of an erectable or collapsible easel, in an assembled state, in accordance with the present disclosure.
Figure 22B:
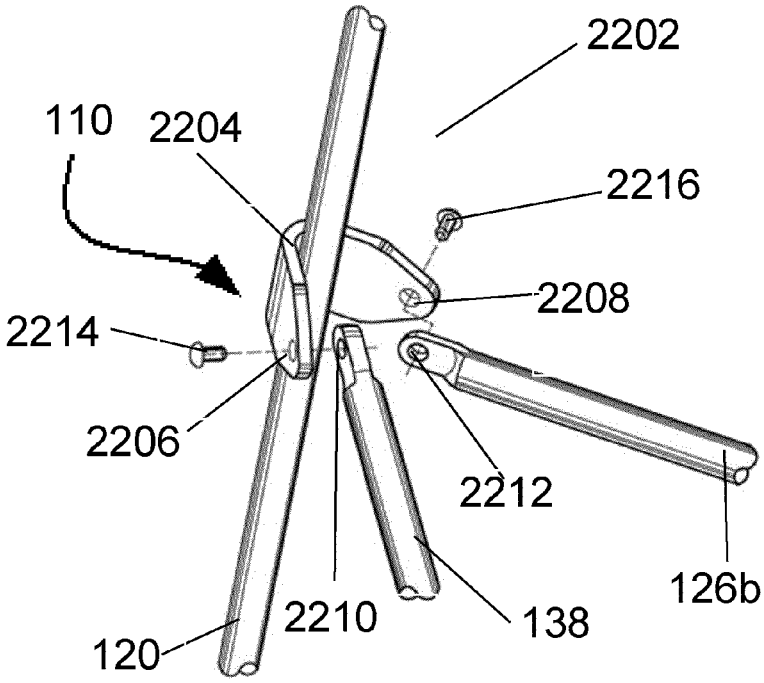
FIG. 22B is a perspective view of the first embodiment of a fixedly mounted pivotable interconnection of a bracing assembly and a forward easel leg of an erectable or collapsible easel, in an unassembled state, in accordance with the present disclosure.

FIG. 22A is a perspective view of a first embodiment of a fixedly mounted pivotable interconnection 2202 or of a bracing assembly 126 and the first easel leg 120 of an erectable or collapsible easel 100, in an assembled state, in accordance with the present disclosure. FIG. 22A is a perspective view of the first embodiment of the fixedly mounted pivotable interconnection 110 in an unassembled state, in accordance with the present disclosure. In this embodiment, a first reinforcement member 2204 is rigidly attached to the first leg 120 at the second attachment point 110 of the first leg 120. The first reinforcement member 2204 can be, for example, welded, glued, crimped, and or bolted to the first leg 120. The first reinforcement member 2204 comprises a first bore hole 2206 and a second bore hole 2208. An end of the alpha arm 138 that is fixedly attached to the second attachment point 110 of the first leg 120 comprises a third bore hole 2210. The first end of the beta support member 126*b* that is fixedly attached to the second attachment point 110 of the first leg 120 comprises a fourth bore hole 2212. A first pivot pin 2214 engages the first reinforcement member 2004 through the first bore hole 2206 and engages the end of the alpha arm 138 through the third bore hole 2210, thereby fixedly attaching the alpha arm 138 to the second attachment point 110 of the first leg 120 in a manner that permits the alpha arm 138 to pivot. A second pivot pin 2216 engages the first reinforcement member 2204 through the second bore hole 2208 and engages first end of the beta support member 126*b* through the fourth bore hole 2212, thereby fixedly attaching the beta support member 126*b* to the second attachment point 110 of the first leg 120 in a manner that permits the beta support member 126*b* to pivot. In like manner, but not shown in FIG. 22, a second reinforcement member is rigidly attached to the second leg 122 at the second attachment point 142 of the second leg. The second reinforcement member comprises a fifth bore hole and a sixth bore hole. An end of the beta arm 140 that is fixedly attached to the second attachment point 142 of the second leg comprises a seventh bore hole. The second end of the gamma support member 126*c* that is fixedly attached to the second attachment point 142 of the second leg 122 comprises an eight bore hole. A third pivot pin engages the second reinforcement member through the fifth bore hole and engages the end of the beta arm 140 through the seventh bore hole, thereby fixedly attaching the beta arm 140 to the second attachment point 142 of the second leg in a manner that permits the beta arm 140 to pivot. A fourth pivot pin engages the second reinforcement member through the sixth bore hole and engages second end of the gamma support member 126*c* through the eighth bore hole, thereby fixedly attaching the gamma support member 126*c* to the second attachment point 142 of the second leg 122 in a manner that permits the gamma support member 126*c* to pivot.

Figure 23:
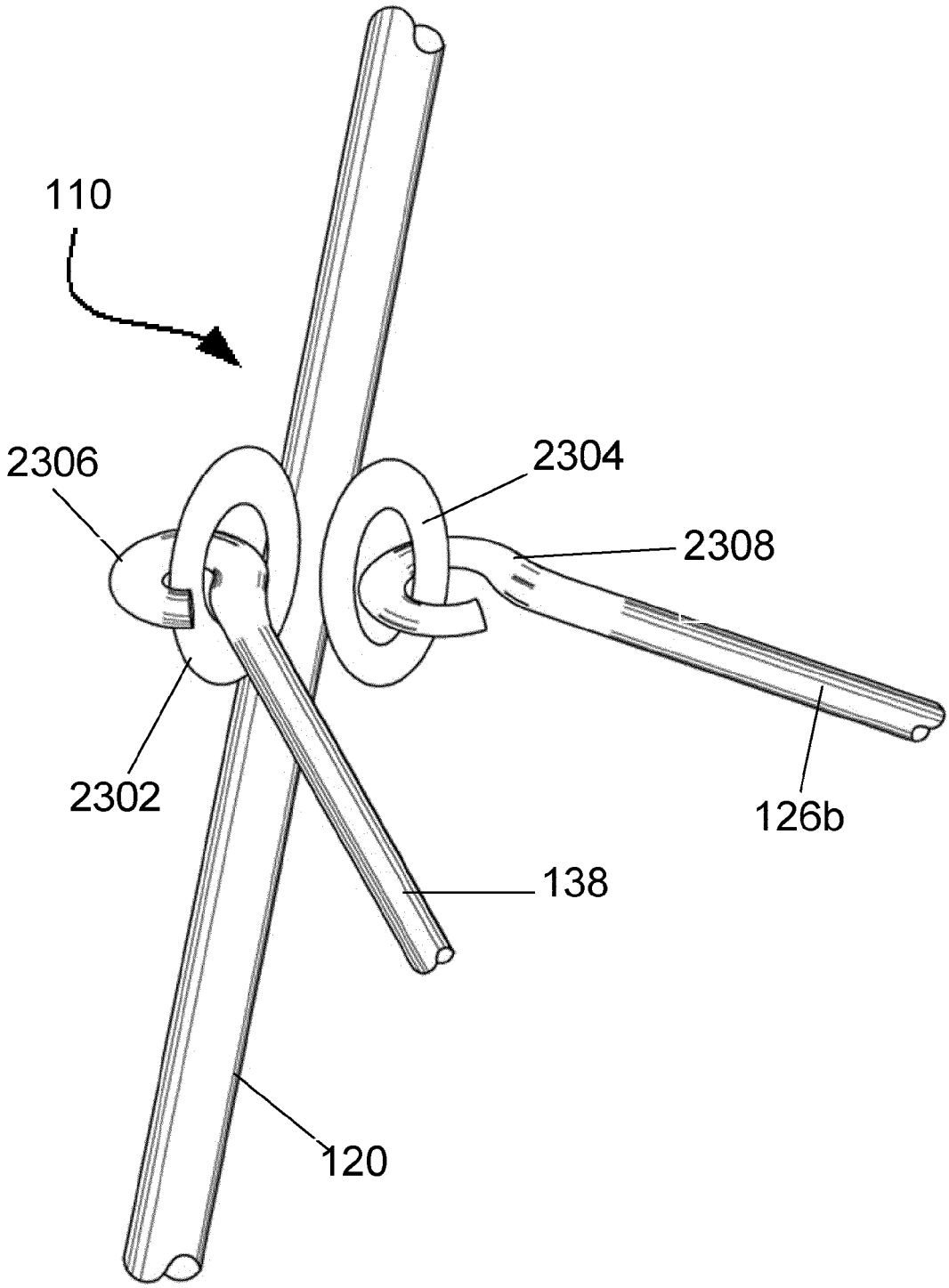
FIG. 23 is a perspective view of a second embodiment of a fixedly mounted pivotable interconnection of a bracing assembly and a forward easel leg of an erectable or collapsible easel in accordance with the present disclosure.

FIG. 23 is a perspective view of a second embodiment of a fixedly mounted pivotable interconnection 110 of a bracing assembly 126 and the first easel leg 120 of an erectable or collapsible easel 100 in accordance with the present disclosure. In this second embodiment, a first loop 2302 is rigidly attached (e.g., welded, glued, bolted, etc.) to the first leg 120 at the second attachment point 110 of the first leg. An end of the alpha arm 138 that is fixedly attached to the second attachment point 110 of the first leg 120 comprises a first bend 2306. The first bend 2306 of the alpha arm 138 engages the first loop 2302 thereby fixedly attaching the alpha arm 138 to the second attachment point 110 of the first leg 120 in a manner that permits the alpha arm 138 to pivot. A second loop 2304 is rigidly attached to the first leg 120 at the second attachment point 110 of the first leg 120. The first end of the beta support member 126*b* that is fixedly attached to the second attachment point 110 of the first leg 120 comprises a first bend 2308 and the first bend 2308 of the beta support member 126*b* engages the second loop 1304 thereby fixedly attaching the beta support member 126*b* to the second attachment point 110 of the first leg 110 in a manner that permits the beta support member 126*b* to pivot.

Similarly, although not shown in FIG. 23, a third loop is rigidly attached to the second leg 122 at the second attachment point 142 of the second leg 122. An end of the beta arm 140 that is fixedly attached to the second attachment point 142 of the second leg 122 comprises a first bend. The first bend of the beta arm 140 engages the third loop thereby fixedly attaching the beta arm 140 to the second attachment point 142 of the second leg 122 in a manner that permits the beta arm 140 to pivot. A fourth loop is rigidly attached to the second leg 122 at the second attachment point 142 of the second leg 120. The second end of the gamma support member 126*c* that is fixedly attached to the second attachment point 142 of the second leg 122 comprises a first bend. The first bend of the gamma support member 126*c* engages the fourth loop thereby fixedly attaching the gamma support member 126*c* to the second attachment point 142 of the second leg 122 in a manner that permits the gamma support member 126*c* to pivot.

Figure 24A:
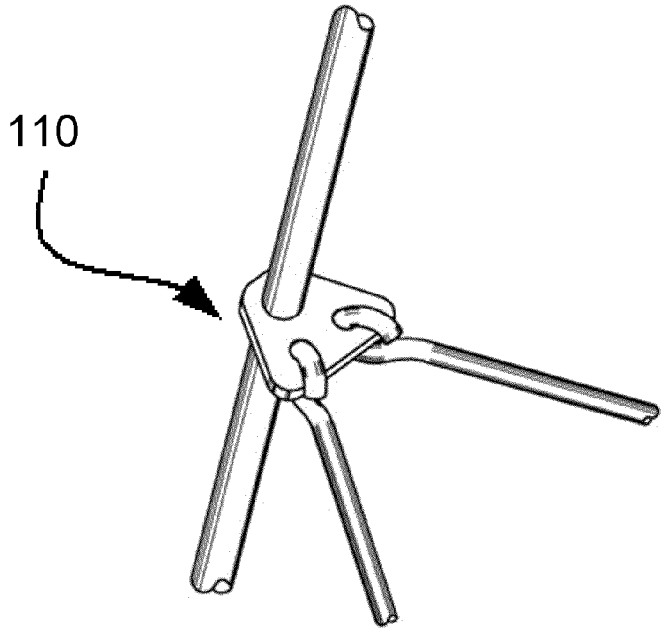
FIG. 24A is a perspective view of a third embodiment of a fixedly mounted pivotable interconnection of a bracing assembly and a forward easel leg of an erectable or collapsible easel, in an assembled state, in accordance with the present disclosure.
Figure 24B:
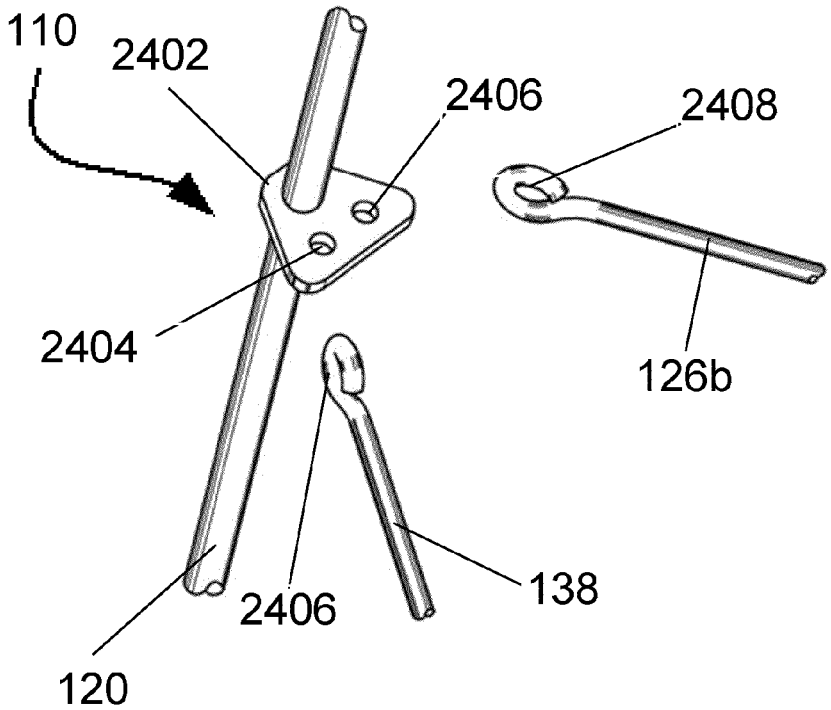
FIG. 24B is a perspective view of the third embodiment of a fixedly mounted pivotable interconnection of a bracing assembly and a forward easel leg of an erectable or collapsible easel, in an unassembled state, in accordance with the present disclosure.

FIG. 24A is a perspective view of a third embodiment of a fixedly mounted pivotable interconnection 110 of a bracing assembly 126 and a first easel leg 120 of an erectable or collapsible easel 100, in an assembled state, in accordance with the present disclosure. FIG. 24B is a perspective view of the third embodiment of the fixedly mounted pivotable interconnection 110 in an unassembled state, in accordance with the present disclosure. 20. In the third embodiment of a fixedly mounted pivotable interconnection 110, a first reinforcement member 2402 is rigidly attached to the first leg 120 at the second attachment point 110 of the first leg 124. The first reinforcement member 2402 comprises a first bore hole 2404 and a second bore hole 2406. An end of the alpha arm 183 is fixedly attached to the second attachment point 110 of the first leg 120 comprises a first bend 2406. The first end of the beta support 126*b* member that is fixedly attached to the second attachment point 110 of the first leg 120 comprises a first bend 2408. The first bend 2406 of the alpha arm 138 passes through the first bore hole 2404 thereby fixedly attaching the alpha arm 138 to the second attachment point 110 of the first leg 120 in a manner that permits the alpha arm 138 to pivot. The first bend 2408 of the beta support member 126*b* passes through the second bore hole 2406 thereby fixedly attaching the beta support member 126*b* to the second attachment point 110 of the first leg 120 in a manner that permits the beta support member 126*b* to pivot. Similarly, but not shown in FIG. 24, a second reinforcement member is rigidly attached to the second leg 122 at the second attachment point 142 of the second leg 122. The second reinforcement member comprises a third bore hole and a fourth bore hole. An end of the beta arm 140 that is fixedly attached to the second attachment point 142 of the second leg 122 comprises a bend. The second end of the gamma support 126*c* member that is fixedly attached to the second attachment point 142 of the second leg 122 comprises a bend. The bend of the beta arm 140 passes through the third bore hole thereby fixedly attaching the beta arm 140 to the second attachment point 142 of the second leg 122 in a manner that permits the beta arm 140 to pivot. The bend of the gamma support member 126*b* passes through the fourth bore hole thereby fixedly attaching the gamma support member 126*b* to the second attachment point 142 of the second leg 122 in a manner that permits the gamma support member 126*b* to pivot.

All references cited herein are incorporated herein by reference in their entirety and for all purposes to the same extent as if each individual publication or patent was specifically and individually indicated to be incorporated by reference in its entirety for all purposes.

The foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A collapsible easel comprising:

(A) a set of three legs, each of the three legs having a first end and a second end, the first end of each of the three legs being attached with one another at an apex, whereby the three legs are moveable with respect to one another about the apex such that the three legs are moveable between a collapsed position and an opened position; wherein each of the three legs are disposed substantially adjacent one another in the collapsed position, the second end of each of the three legs is spaced a distance away from each other in the opened position whereby the three legs form an upright pyramidal configuration when the three legs are in the opened position with the second end of each of the three legs engaging a substrate;

(B) a reinforcing member comprising (i) a first reinforcing arm, (ii) a second reinforcing second arm, and (iii) a pivoting mechanism that joins the first reinforcing arm and the second reinforcing arm, wherein the first reinforcing arm is fixedly attached to a first attachment point of a first leg in the set of three legs, wherein the first reinforcing arm is configured to pivot about the first attachment point of the first leg;

the second reinforcing arm is fixedly attached to a first attachment point of a second leg in the set of three legs, wherein the second reinforcing arm is configured to pivot about the first attachment point of the second leg;

whereby the reinforcing member is pivotable, about said pivoting mechanism, between a first reinforcing member position and a second reinforcing member position; and (C) a bracing assembly comprising:

(i) an alpha support member comprising (a) a first alpha arm, (b) a second alpha arm, and (c) an interlocking mechanism that joins the first alpha arm and the second alpha arm, wherein the first alpha arm is fixedly attached to a second attachment point of the first leg, wherein the first alpha arm is configured to pivot about the second attachment point of the first leg;

the second alpha arm is fixedly attached to a second attachment point of the second leg, wherein the second alpha arm is configured to pivot about the second attachment point of the second leg, whereby the alpha support member is pivotable about said interlocking mechanism between a first alpha support member position and a second alpha support member position, (ii) a beta support member comprising a first end and a second end, wherein the first end of the beta support member is fixedly attached to the second attachment point of the first leg, wherein the first end of the beta support member is configured to pivot about the second attachment point of the first leg, the second end of the beta support member is slidably attached to a third leg in the set of three legs, whereby the beta support member is pivotable about the first end of the beta support member between a first beta support member position and a second beta support member position, and (iii) a gamma support member comprising a first end and a second end, wherein the first end of the gamma support member is slidably attached to the third leg, the second end of the gamma support member is fixedly attached to the second attachment point of the second leg, wherein the second end of the gamma support member is configured to pivot about the second attachment point of the second leg, whereby the third gamma member is pivotable about the second end of the gamma support member between a first gamma support member position and a second gamma support member position, wherein the second end of the beta support member and the first end of the gamma support member are attached to each other, and wherein the set of three legs, the reinforcing member, and the bracing assembly are configured so that when the three legs are in the collapsed position, the reinforcing member is in the first reinforcing member position, the alpha support member is in the first alpha support member position, the beta support member is in the first beta support member position, and the gamma support member is in the first gamma support member position, and when the three legs are in the opened position, the reinforcing member is in the second reinforcing member position, the alpha support member is in the second alpha support member position, the beta support member is in the second beta support member position, and the third gamma member is in the second gamma support member position.

2. The collapsible easel of claim 1, wherein the first end of the first leg comprises a first bore hole, the first end of the second leg comprises a second bore hole, the apex comprises a pivot pin that engages first end of the first leg through the first bore hole and engages the first end of the second leg through the second bore hole thereby pivotably joining the first end of the first leg to the first end of the second leg, the first end of the third leg comprises a bend that engages the first leg and the second leg at the apex thereby pivotably attaching the third leg to the first leg and the second leg.

3. The collapsible easel of claim 1, wherein the apex comprises a u-shaped member comprising a first end and a second end, the first end of the u-shaped member comprises a first bore hole, the second end of the u-shaped member comprises a second bore hole, the first end of the first leg comprises a third bore hole, the first end of the second leg comprises a fourth bore hole, a first pivot pin engages the first end of the u-shaped member through the first bore hole and engages the first end of the first leg through the third bore hole thereby pivotably joining the first end of the first leg to the first end of the u-shaped member, a second pivot pin engages the second end of the u-shaped member through the second bore hole and engages the first end of the second leg through the fourth bore hole thereby pivotably joining the first end of the second leg to the second end of the u-shaped member, and the first end of the third leg comprises a bend that engages the u-shaped member thereby attaching the third leg to the first leg and the second leg.

4. The collapsible easel of claim 1, wherein the apex comprises a rigid interlinking member having a first hook and a second hook, the first end of the first leg is pivotably joined to the first hook of the rigid interlinking member, the first end of the second leg is pivotably joined to the second hook of the rigid interlinking member, and the first end of the third leg comprises a bend that engages an intermediate portion of the rigid interlinking member between the first hook and the second hook thereby attaching the third leg to the first leg and the second leg.

5. The collapsible easel of claim 1, wherein the apex comprises a triangular rigid plate, wherein the triangular rigid plate comprises a first bore hole, a second bore hole, and a third bore hole, and wherein the first end of the first leg comprises a first bend portion that pivotably engages the triangular rigid plate through the first bore hole, the first end of the second leg comprises a second bend portion that pivotably engages the triangular rigid plate through the second bore hole, and the first end of the third leg comprises a third bend portion that pivotably engages the triangular rigid plate through the third bore hole.

6. The collapsible easel of claim 1, wherein the apex comprises an interconnect that joins a first portion and a second portion of a first bend in a first end of the third leg, the first end of the first leg comprises a second bend that pivotably engages the interconnect, the first end of the second leg comprises a third bend that pivotably engages the interconnect.

7. The collapsible easel of claim 1, wherein the first end of the first leg comprises a first bend, the first end of the second leg comprises a second bend, the first bend and the second bend are interlocked with respect to each other, thereby pivotably interconnecting the first leg and the second leg, the first end of the third leg comprises a third bend that engages the second leg at a position proximate to the second bend, thereby pivotably attaching the third leg to the first leg and the second leg.

8. The collapsible easel of claim 1, wherein a first end of the first reinforcing arm is opposed to an end of the first reinforcing arm that is attached to the first attachment point of the first leg, and wherein the first end of the first reinforcing arm comprises a first bore hole, a first end of the second reinforcing arm is opposed to an end of the second reinforcing arm that is attached to the first attachment point of the second leg, and wherein the first end of the second reinforcing arm comprises a second bore hole, and the pivoting mechanism of the reinforcing member is a pivot pin that engages the first reinforcing arm through the first bore hole and engages the second reinforcing arm through the second bore hole, thereby pivotably joining the first and second reinforcing arms of the reinforcing member.

9. The collapsible easel of claim 1, wherein a first end of the first reinforcing arm is opposed to an end of the first reinforcing arm that is attached to the first attachment point of the first leg, and wherein the first end of the first reinforcing arm comprises a first attachment hook, a first end of the second reinforcing arm is opposed to an end of the second reinforcing arm that is attached to the first attachment point of the second leg, and wherein the first end of the second reinforcing arm comprises a second attachment hook, the first attachment hook interlocks with the second attachment hook to form said pivoting mechanism that pivotably joins the first and second reinforcing arms of the reinforcing member, the end of the first reinforcing arm that is attached to the first attachment point of the first leg comprises a third attachment hook, the end of the second arm that is attached to the first attachment point of the second leg comprises a fourth attachment hook, the first attachment point of the first leg comprises a first attachment loop, the first attachment point of the second leg comprises a second attachment loop, the third attachment hook is engaged with the first attachment loop thereby pivotably attaching the first reinforcing arm to the first leg, and the fourth attachment hook is engaged with the second attachment loop thereby pivotably attaching the second reinforcing arm to the second leg.

10. The collapsible easel of claim 1, wherein the first reinforcing arm comprises a first reinforcing loop, the second reinforcing arm comprises a second reinforcing loop, the first reinforcing loop interlocks with the second reinforcing loop to form said pivoting mechanism that pivotably joins the first and second reinforcing arms, the first attachment point of the first leg comprises a first attachment loop, the first attachment point of the second leg comprises a second attachment loop, the first reinforcing loop interlocks with the first attachment loop thereby pivotably attaching the first reinforcing arm to the first leg, and the second reinforcing loop interlocks with the second attachment loop thereby pivotably attaching the second reinforcing arm to the second leg.

11. The collapsible easel of claim 1, wherein the interlocking mechanism comprises a reinforcement member, wherein reinforcement member comprises a first bore hole and a second bore hole, an end of the first alpha arm that is opposite an end of the first alpha arm that is fixedly attached to the second attachment point of the first leg comprises a third bore hole, an end of the second alpha arm that is opposite an end of the second alpha arm that is fixedly attached to the second attachment point of the second leg comprises a fourth bore hole, a first pivot pin engages the reinforcement member through the first bore hole and engages the first alpha arm through the third bore hole, thereby pivotably joining the interlocking mechanism and the first alpha arm, and a second pivot pin engages the reinforcement member through the second bore hole and engages the second alpha arm through the third bore hole, thereby pivotably joining the interlocking mechanism and the second alpha arm.

12. The collapsible easel of claim 1, wherein an end of the first alpha arm that is opposite an end of the first alpha arm that is fixedly attached to the second attachment point of the first leg comprises a first bore hole, an end of the second alpha arm that is opposite an end of the second alpha arm that is fixedly attached to the second attachment point of the second leg comprises a second bore hole, and the interlocking mechanism is a pivot pin that engages the first alpha arm through the first bore hole and engages the second alpha arm through the second bore hole, thereby pivotably joining the first alpha arm and the second alpha arm to each other.

13. The collapsible easel of claim 1, wherein the first end of the gamma support member comprises a bend that wraps around the third leg, the first end of the beta support member comprises a first bore hole in a first portion of the bend and a second bore hole in a second portion of the bend;

the second end of the beta support member comprises a third bore hole, a pivot pin engages the gamma support member through the first bore hole and the second bore hole and engages the beta support member through the third bore hole, thereby (i) attaching the second end of the beta support member and the first end of the gamma support member to each other, (ii) slidably attaching the second end of the beta support member to the third leg, and (iii) slidably attaching the first end of the gamma support member to the third leg.

14. The collapsible easel of claim 1, wherein the second end of the beta support member comprises a first bend that partially wraps around the third leg, the second end of the beta support member comprises a first bore hole, the first end of the gamma support member comprises a second bend that partially wraps around the third leg, the first end of the gamma support member comprises a second bore hole, a pivot pin engages the beta support member through the first bore hole and engages the gamma support member through the second bore hole, thereby attaching the second end of the beta support member and the first end of the gamma support member to each other, and wherein the collapsible easel further comprises a bead assembly, wherein the bead assembly comprises:

(i) a bead body having a bead bore, and (ii) an attachment loop fixedly attached to the bead body, and wherein the bead body is slidably engaged to the third leg through the bead bore, and the first bend and/or the second bend passes through the attachment loop thereby slidably attaching the second end of the beta support member to the third leg and slidably attaching the first end of the gamma support member to the third leg, and wherein the easel further comprises a bead stop mounted on the third leg, wherein the bead stop limits a range that the bead body can traverse on the third leg.

15. The collapsible easel of claim 1, wherein the second end of the beta support member comprises a first bend that partially wraps around the third leg, the second end of the beta support member comprises a first bore hole, the first end of the gamma support member comprises a second bend that partially wraps around the third leg, the first end of the gamma support member comprises a second bore hole, a pivot pin engages the beta support member through the first bore hole and engages the gamma support member through the second bore hole, thereby attaching the second end of the beta support member and the first end of the gamma support member to each other, and wherein the collapsible easel further comprises a tube assembly, wherein the tube assembly comprises:

(i) a tube body having a tube bore, and (ii) an attachment loop fixedly attached to the tube body, and wherein the tube body is slidably engaged to the third leg through the tube bore, and the first bend and/or the second bend passes through the attachment loop thereby slidably attaching the second end of the beta support member to the third leg and slidably attaching the first end of the gamma support member to the third leg, and wherein the collapsible easel further comprises a tube stop mounted on the third leg, wherein the tube stop limits a range that the tube body can traverse on the third leg.

16. The collapsible easel of claim 1, wherein the collapsible easel further comprises a sliding plate having a first bore hole, a second bore hole, and a third bore hole, wherein, the sliding plate is slidably engaged to the third leg through the first bore hole, the second end of the beta support member comprises a first bend that passes through the second bore hole, and the first end of the gamma support member comprises a second bend that passes through the third bore hole, thereby (i) attaching the second end of the beta support member and the first end of the gamma support member to each other, (ii) slidably attaching the second end of the beta support member to the third leg, and (iii) slidably attaching the first end of the gamma support member to the third leg.

17. The collapsible easel of claim 1, wherein the collapsible easel further comprises a sliding plate having a first bore hole, a first bore hole pair, and a second bore hole pair, wherein, the sliding plate is slidably engaged to the third leg through the first bore hole, the second end of the beta support member comprises a first bend that passes through the first bore hole pair, and the first end of the gamma support member comprises a second bend that passes through the second bore hole pair, thereby (i) attaching the second end of the beta support member and the first end of the gamma support member to each other, (ii) slidably attaching the second end of the beta support member to the third leg, and (iii) slidably attaching the first end of the gamma support member to the third leg.

18. The collapsible easel of claim 1, wherein the collapsible easel further comprises:

(A) a first reinforcement member rigidly attached to the first leg at the second attachment point of the first leg, wherein the first reinforcement member comprises a first bore hole and a second bore hole, an end of the alpha arm that is fixedly attached to the second attachment point of the first leg comprises a third bore hole, the first end of the beta support member that is fixedly attached to the second attachment point of the first leg comprises a fourth bore hole, and wherein a first pivot pin engages the first reinforcement member through the first bore hole and engages the end of the alpha arm through the third bore hole, thereby fixedly attaching the alpha arm to the second attachment point of the first leg in a manner that permits the alpha arm to pivot, and a second pivot pin engages the first reinforcement member through the second bore hole and engages first end of the beta support member through the fourth bore hole, thereby fixedly attaching the beta support member to the second attachment point of the first leg in a manner that permits the beta support member to pivot; and (B) a second reinforcement member rigidly attached to the second leg at the second attachment point of the second leg, wherein the second reinforcement member comprises a fifth bore hole and a sixth bore hole, an end of the beta arm that is fixedly attached to the second attachment point of the second leg comprises a seventh bore hole, the second end of the gamma support member that is fixedly attached to the second attachment point of the second leg comprises an eight bore hole, and wherein a third pivot pin engages the second reinforcement member through the fifth bore hole and engages the end of the beta arm through the seventh bore hole, thereby fixedly attaching the beta arm to the second attachment point of the second leg in a manner that permits the beta arm to pivot, and a fourth pivot pin engages the second reinforcement member through the sixth bore hole and engages second end of the gamma support member through the eighth bore hole, thereby fixedly attaching the gamma support member to the second attachment point of the second leg in a manner that permits the gamma support member to pivot.

19. The collapsible easel of claim 1, wherein the collapsible easel further comprises:

(A) a first loop rigidly attached to the first leg at the second attachment point of the first leg, wherein an end of the alpha arm that is fixedly attached to the second attachment point of the first leg comprises a first bend, the first bend of the alpha arm engages the first loop thereby fixedly attaching the alpha arm to the second attachment point of the first leg in a manner that permits the alpha arm to pivot, (B) a second loop rigidly attached to the first leg at the second attachment point of the first leg, wherein the first end of the beta support member that is fixedly attached to the second attachment point of the first leg comprises a first bend, and the first bend of the beta support member engages the second loop thereby fixedly attaching the beta support member to the second attachment point of the first leg in a manner that permits the beta support member to pivot, (C) a third loop rigidly attached to the second leg at the second attachment point of the second leg, wherein an end of the beta arm that is fixedly attached to the second attachment point of the second leg comprises a first bend, the first bend of the beta arm engages the third loop thereby fixedly attaching the beta arm to the second attachment point of the second leg in a manner that permits the beta arm to pivot, and (D) a fourth loop rigidly attached to the second leg at the second attachment point of the second leg, wherein the second end of the gamma support member that is fixedly attached to the second attachment point of the second leg comprises a first bend, and a first bend of the gamma support member engages the fourth loop thereby fixedly attaching the gamma support member to the second attachment point of the second leg in a manner that permits the gamma support member to pivot.

20. The collapsible easel of claim 1, wherein the collapsible easel further comprises:

(A) a first reinforcement member rigidly attached to the first leg at the second attachment point of the first leg, wherein the first reinforcement member comprises a first bore hole and a second bore hole, an end of the alpha arm that is fixedly attached to the second attachment point of the first leg comprises a first bend, the first end of the beta support member that is fixedly attached to the second attachment point of the first leg comprises a first bend, and wherein the first bend of the alpha arm passes through the first bore hole thereby fixedly attaching the alpha arm to the second attachment point of the first leg in a manner that permits the alpha arm to pivot, and the first bend of the beta support member passes through the second bore hole thereby fixedly attaching the beta support member to the second attachment point of the first leg in a manner that permits the beta support member to pivot; and (B) a second reinforcement member rigidly attached to the second leg at the second attachment point of the second leg, wherein the second reinforcement member comprises a third bore hole and a fourth bore hole, an end of the beta arm that is fixedly attached to the second attachment point of the second leg comprises a bend, the second end of the gamma support member that is fixedly attached to the second attachment point of the second leg comprises a bend, and wherein the bend of the beta arm passes through the third bore hole thereby fixedly attaching the beta arm to the second attachment point of the second leg in a manner that permits the beta arm to pivot, and the bend of the gamma support member passes through the fourth bore hole thereby fixedly attaching the gamma support member to the second attachment point of the second leg in a manner that permits the gamma support member to pivot.

21. A collapsible easel comprising:

(A) a set of three legs, each of the three legs having a first end and a second end, the first end of each of the three legs being attached with one another at an apex means, whereby the three legs are moveable with respect to one another about the apex means such that the three legs are moveable between a collapsed position and an opened position; wherein each of the three legs are disposed substantially adjacent one another in the collapsed position, the second end of each of the three legs is spaced a distance away from each other in the opened position whereby the three legs form an upright pyramidal configuration when the three legs are in the opened position with the second end of each of the three legs engaging a substrate;

(B) a reinforcing member comprising (i) a first reinforcing arm, (ii) a reinforcing second arm, and (iii) a pivoting means that pivotably joins the first reinforcing arm and the second reinforcing arm to each other, wherein the first reinforcing arm is fixedly attached to a first attachment point of a first leg in the set of three legs by a first attachment means, wherein the first reinforcing arm is configured to pivot about the first attachment point of the first leg;

the second reinforcing arm is fixedly attached to a first attachment point of a second leg in the set of three legs by a second attachment means, wherein the second reinforcing arm is configured to pivot about the first attachment point of the second leg;

whereby the reinforcing member is pivotable, about said pivoting mechanism, between a first reinforcing member position and a second reinforcing member position; and (C) a bracing assembly comprising:

(i) an alpha support member comprising (a) a first alpha arm, (b) a second alpha arm, and (c) an interlocking means that pivotably joins the first alpha arm and the second alpha arm to each other, the first alpha arm is fixedly attached to a second attachment point of the first leg by a third attachment means, wherein the first alpha arm is configured to pivot about the second attachment point of the first leg;

the second alpha arm is fixedly attached to a second attachment point of the second leg by a fourth attachment means, wherein the second alpha arm is configured to pivot about the second attachment point of the second leg, whereby the alpha support member is pivotable about said interlocking means between a first alpha support member position and a second alpha support member position, (ii) a beta support member comprising a first end and a second end, wherein the first end of the beta support member is fixedly attached to the second attachment point of the first leg by a fifth attachment means, wherein the first end of the beta support member is configured to pivot about the second attachment point of the first leg, the second end of the beta support member is slidably attached to a third leg in the set of three legs by a sixth attachment means, whereby the beta support member is pivotable about the first end of the beta support member between a first beta support member position and a second beta support member position, and (iii) a gamma support member comprising a first end and a second end, wherein the first end of the gamma support member is slidably attached to the third leg by a seventh attachment means, the second end of the gamma support member is fixedly attached to the second attachment point of the second leg by an eight attachment means, wherein the second end of the gamma support member is configured to pivot about the second attachment point of the second leg, whereby the third gamma member is pivotable about the second end of the gamma support member between a first gamma support member position and a second gamma support member position, wherein the second end of the beta support member and the first end of the gamma support member are attached to each other by a ninth attachment means, and wherein the set of three legs, the reinforcing member, and the bracing assembly are configured so that when the three legs are in the collapsed position, the reinforcing member is in the first reinforcing member position, the alpha support member is in the first alpha support member position, the beta support member is in the first beta support member position, and the gamma support member is in the first gamma support member position, and when the three legs are in the opened position, the reinforcing member is in the second reinforcing member position, the alpha support member is in the second alpha support member position, the beta support member is in the second beta support member position, and the third gamma member is in the second gamma support member position.

* * * * *